United States Patent [19]

Donohoo

[11] 4,340,808

[45] Jul. 20, 1982

[54] TIME LOGGING APPARATUS

[76] Inventor: Dan J. Donohoo, 3175 Hafner Ct., Shoreview, Minn. 55116

[21] Appl. No.: 19,146

[22] Filed: Mar. 9, 1979

[51] Int. Cl.[3] ..... G07C 1/04

[52] U.S. Cl. ..... 235/92 AC; 235/92 T; 368/96

[58] Field of Search ..... 235/92 AC, 92 T, 92 DP; 364/705, 406, 569; 58/24 A; 368/70, 46, 96, 107

[56] References Cited

U.S. PATENT DOCUMENTS

| | | | |
|---|---|---|---|
| 3,648,243 | 3/1972 | Wiggins | 235/92 AC |
| 4,164,038 | 8/1979 | Nachtigal | 235/92 AC |
| 4,195,220 | 3/1980 | Bristol et al. | 235/92 T |

OTHER PUBLICATIONS

Advertising Brochure for WESPAC ITR-700 Interim Time Recorder.

*Primary Examiner*—Joseph M. Thesz

[57] ABSTRACT

Time logging apparatus comprising a microprocessor programmed to distribute clock signals within memory locations corresponding to a plurality of primary accounts, each having an associated account key, is disclosed. The account to which any clock signal is added is determined exclusively by the last activated account key. A numerical display responds to actuation of function and/or account keys by displaying a time interval corresponding to the count in a selected memory location, the total time chargeable to the primary accounts, or additional time to be charged to a selected account. An indicator lamp adjacent each account key indicates whether the account has activity associated therewith at any time, and a removeable form having spaces arranged to be aligned with the account keys and lamps is provided for identifying the accounts and time intervals chargeable to each account.

18 Claims, 15 Drawing Figures

ROUTINE CR

ROUTINE SC

ROUTINE XF

ROUTINE XD

ROUTINE XA

ROUTINE AF

ROUTINE FA

ROUTINE FA

ROUTINE FS

SUBROUTINE OX

TIME LOGGING APPARATUS

BACKGROUND OF THE INVENTION

The present invention relates generally to time keeping apparatus, and more specifically to apparatus requiring minimum operator attention for monitoring, displaying and facilitating the making of a written record of time chargeable to a plurality of accounts.

The keeping of time chargeable to individual accounts or tasks of interest has long been a necessary but burdensome chore. Time records are important for a variety of purposes, of which one of the more obvious is providing a basis for billing for professional services. In the context of a modern, professional office, the time keeping chore has become increasingly important because of increasing pressure to maximize the amount of billable time. This objective requires keeping accurate time records, of which one facet involves recording small amounts of time involved in the telephone consultations and other brief tasks for a client, patient or customer. Contributing to the burden of keeping time records is the fact that a day's activities frequently involve services for a significant number of clients, patients or customers, and that the total services for any single client during a day's time may be scattered throughout the day.

Many time record keeping aids have been devised and are known. These range very simple devices for facilitating manual monitoring and recording of only the most basic data, to very elaborate computerized systems permitting the monitoring, entry, manipulation, storage and retrieval of a vast amount of data directly or indirectly related to the time keeping task.

Regardless of the type of time keeping device or system, it is generally necessary to manually enter one or more catagories of information or data. At best, such manual processes require some attention and effort, and are a distraction from the primary duties of the professional. As a result, the entry of time keeping data tends to be postponed or neglected, and data inaccurately entered or data on significant blocks of time entirely omitted. Further, neglect, inaccuracies and omissions tend to increase directly with the complexity of the required entries and entry format. However, it is also true that more complete time records generally require more extensive entry of data.

In order to avoid many of the problems associated with previously known time record keeping aids, the applicant has devised a unique compact microprocessor based time logging system having substantial capabilities, and characterized by an exceptionally simple data entry and retrieval format. Function instructions and account information are entered with a maximum of two key actuations on a simple and understandable keyboard. Accordingly, minimum attention and effort are required, thus encouraging prompt and accurate time keeping practices.

SUMMARY OF THE INVENTION

Time logging apparatus in accordance with the present invention basically comprises memory means for storing counts of clock signals respectively corresponding to periods of time chargeable to each of a plurality of accounts, each account having an account switch associated therewith. Microprocessor means operating under program control responds to a single actuation of an account switch by causing subsequent clock signals to be accumulated only for the account associated with that switch. Display means is provided for displaying a time interval corresponding to the count in the memory means for a selected account, the display means being activated by the microprocessor means in response to sequential actuation of a first function key and an account key. Additional storage means may be provided for accumulating of clock signals at an accelerated rate, and, in response to sequential actuation of a second function key and an account key, to add its stored count to the count for the selected account. Further, the microprocessor means may be programmed to cause the additional memory means to accumulate a count at a rate which increases with time, and to provide for optional display modes whereby fractional hours of time are displayed in minutes or in hundredths of an hour.

BRIEF DESCRIPTION OF THE DRAWINGS

FIGS. 5A-5I are flow diagrams for the routines identified in FIG. 4.

DESCRIPTION OF THE PREFERRED EMBODIMENT

Figure 1:
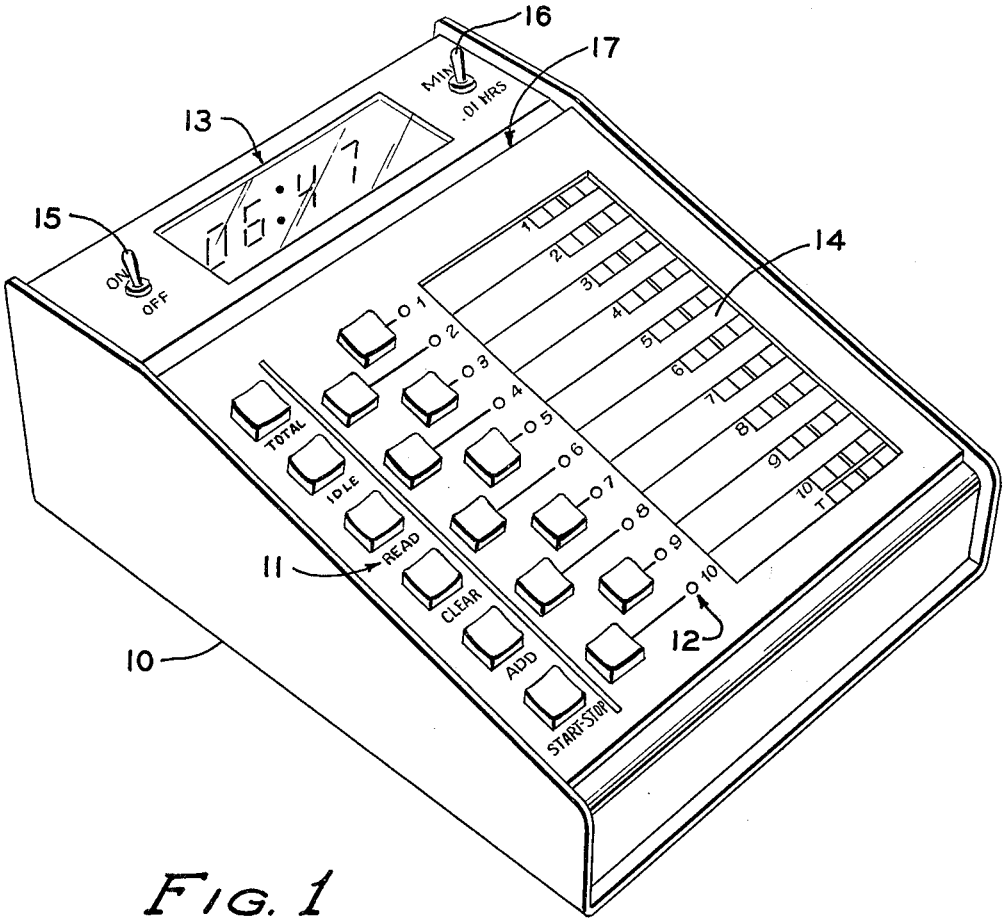
FIG. 1 is a pictorial view of a time logging device in accordance with the applicant's invention.

In the pictorial view of FIG. 1, reference numeral 10 identifies a cabinet which supports and/or houses the various components making up time logging apparatus in accordance with the applicant's invention. The principal external features comprise a keyboard input panel generally identified by reference numeral 11, a plurality of indicator lamps generally identified by reference numeral 12, a numerical display generally identified by reference numeral 13, a removable card 14, and on-off switch 15 and a display mode switch 16. Keyboard 11 includes a plurality of primary account keys, each associated and aligned with a separate one of indicator lamps 12, the indicator lamps and associated account keys being numbered to identify separate accounts. Keyboard 11 also includes six labeled function keys.

The top face of cabinet 10 may be designed with a slot (not shown) located as indicated by reference numeral 17 for permitting card 14 to be inserted and removed. Card 14 includes a plurality of blank spaces for accommodating a written record of account names and time chargeable to each account. Card 14 is arranged so that when it is in place, each blank space thereon is aligned with a separate primary account key and associated indicator lamp.

The six function keys, whose purpose will hereinafter be described in detail, are labeled "TOTAL", "IDLE", "READ", "CLEAR", "ADD", and "START-STOP". Display mode switch 16 permits selection of either of two display formats, whereby a time interval is displayed in either hours and minutes or hours and hundreds of an hours.

The following is a brief description of external operation of the applicant's time logging apparatus. The embodiment shown in FIG. 1 is designed to facilitate the monitoring and recording of time chargeable to any of ten separate accounts. Initially, a card 14 is inserted through a slot at 17 into a holder in the top face of cabinet 10. The names of up to 10 accounts may be noted in the spaces provided on card 14. The time logging apparatus is set in operation by positioning switch 15 in its ON position. Thereafter, until switch 15 is turned OFF, all time is charged to one of the primary accounts or to an idle account. From the time switch 15 is turned ON, and until one of the primary account switches is depressed, time is charged to the idle account. The time in any account remains until cleared, and is not altered by turning switch 15 OFF.

To start charging time to a primary account, the account key associated with the selected account is momentarily depressed. The account to which time is being charged is indicated by illumination of the indicator lamp associated with that account. The active account may be changed simply by momentarily depressing the key associated with a newly selected account, at which time its indicator lamp will illuminate and time thereafter will be charged to that account. There may be time intervals which are not chargeable to any of the primary accounts. Charging of time to a primary account can be interrupted by momentarily depressing the START-STOP key, which causes time thereafter to be charged to the idle account. Depressing of the START-STOP key a second time returns charging of time to the primary account previously being charged.

The READ function key is used to display the time in a selected primary account. The display function is accomplished by depressing the READ key and, within four seconds, depressing the account key for the selected account. As long as the account key is depressed and for four seconds thereafter the associated indicator lamp will flash and the desired account total will be displayed. The TOTAL function key is used to display the sum of the times in all primary accounts. Time in the idle account is displayed by depressing the IDLE key.

The CLEAR function key is used to clear the times from any selected account or all accounts. The clearing function is accomplished by depressing the CLEAR key and within four seconds, depressing a selected primary or IDLE account key or the TOTAL key.

The ADD function is used to add time to any selected primary account. When the ADD key is depressed, the display counts up from 0 at a rate which increases with time. Counting commences at an initial rate, and the counting rate increases as long as the ADD key is continuously actuated, except that the counting rate will not exceed a predetermined maximum rate. After the ADD key is released, the last number displayed will be held in the display for four seconds unless either the ADD key or a primary account key is depressed. If the ADD key is again depressed within the four second interval, the display will start counting up from its present value, again at a rate which commences with the initial rate and increases with time. If a primary account key is depressed within the four second interval, the time on the display will be added to the time already in the selected account. As long as the account key is depressed, and for four seconds thereafter, the associated indicator lamp flashes and the added time is displayed.

As is apparent from the foregoing operational description, the applicant's time logging apparatus is exceptionally simple to understand and operate. Further, it offers considerable functional flexibility and provides most generally needed time keeping information in an exceptionally understandable format. These and other benefits are achieved through the use of microprocessor based apparatus whose general structure will be described in connection with FIG. 2.

Figure 2:
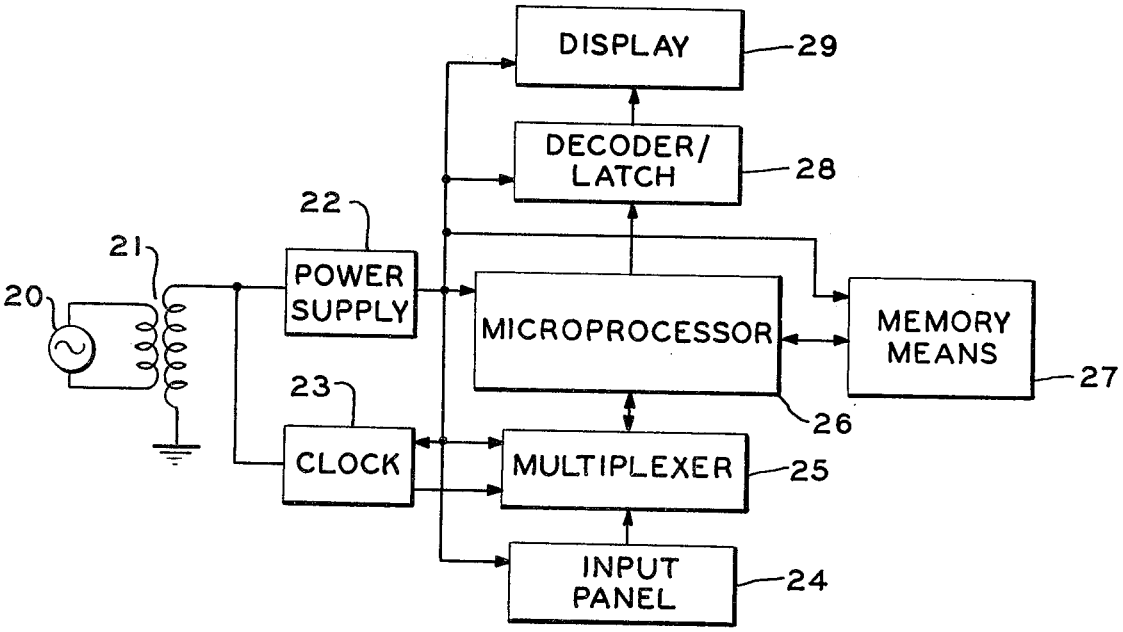
FIG. 2 is a block diagram of the principal functional elements of the applicant's time logging apparatus.

In FIG. 2, reference numeral 20 identifies a conventional primary source of alternating electric current, such as conventional 60 cycle per second current from a public utility. The voltage provided by source 20 is reduced and isolation accomplished by means of a transformer 21 whose output is furnished to a power supply 22 and a clock 23. In addition to transmitting power from primary source 20, power supply 22 may also contain a battery and associated circuitry for supplying back-up power to prevent loss of data in the event of failure of the primary source. Clock 23 utilizes the fixed frequency characteristic of source 20 to establish a time reference for the time logging apparatus. The time reference from clock 23 and signals from an input panel or keyboard 24 are received by a multiplexer 25 which transmits timing, function and account selection inputs to a microprocessor 26 operating under program control.

The program for microprocessor 26 is contained in a read only memory portion of a memory means 27. Memory means 27 also includes a random access memory portion controlled by microprocessor 26 for storing and supplying time data for each of the plurality of primary accounts and the time to be added to any account through operation of the ADD key. Upon actuation of appropriate function and/or account keys, microprocessor 26 supplies signals to a decoder/latch 28 which causes the time in a selected account or the time accumulated through operation of the ADD key to be displayed on a display 29. For purposes of FIG. 2, display 29 also includes a plurality of account indicator lamps which are driven by decoder 28.

Figure 3A:
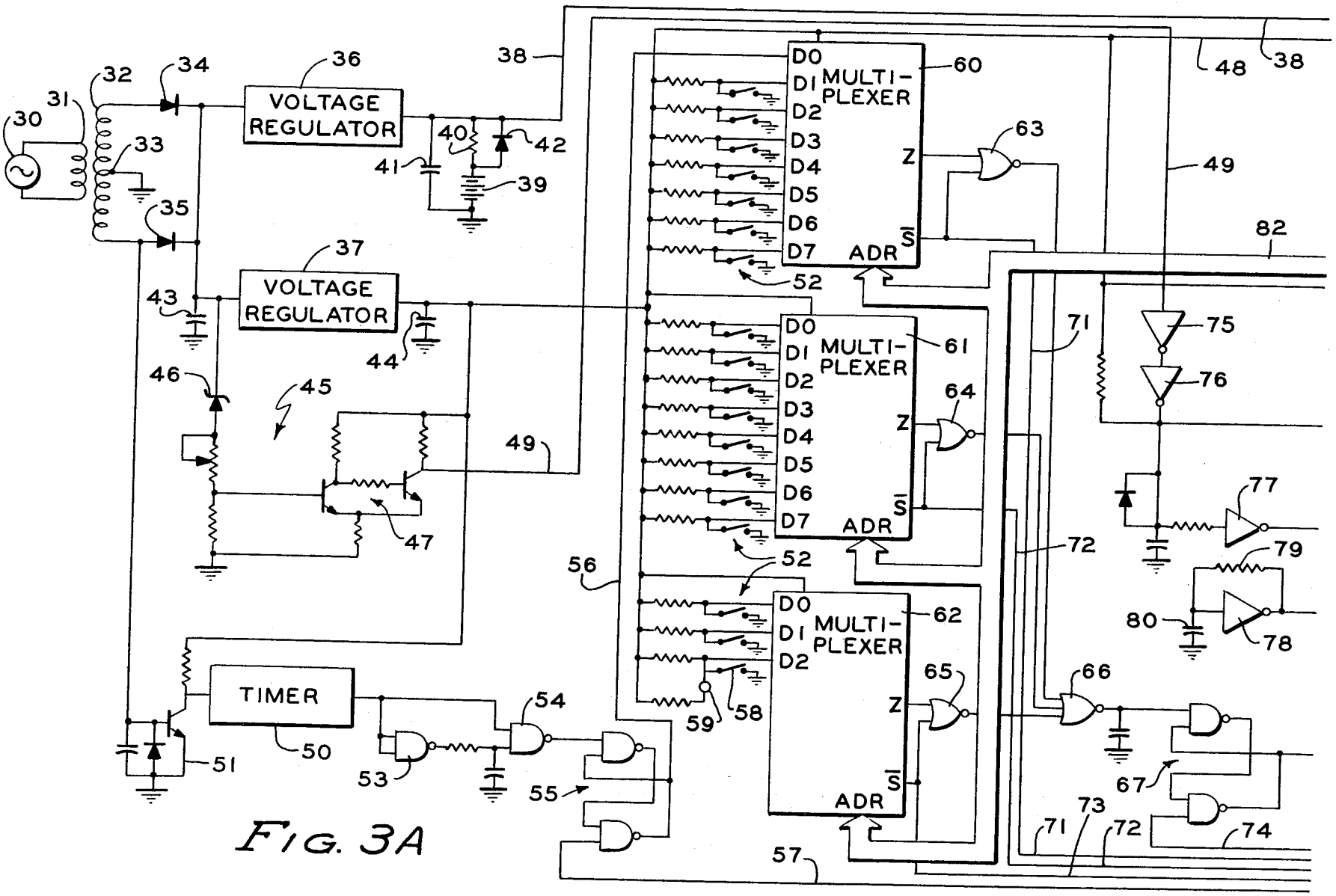
FIGS. 3A and 3B together comprise a schematic diagram of a particular embodiment of the time logging apparatus of FIGS. 1 and 2.
Figure 3B:
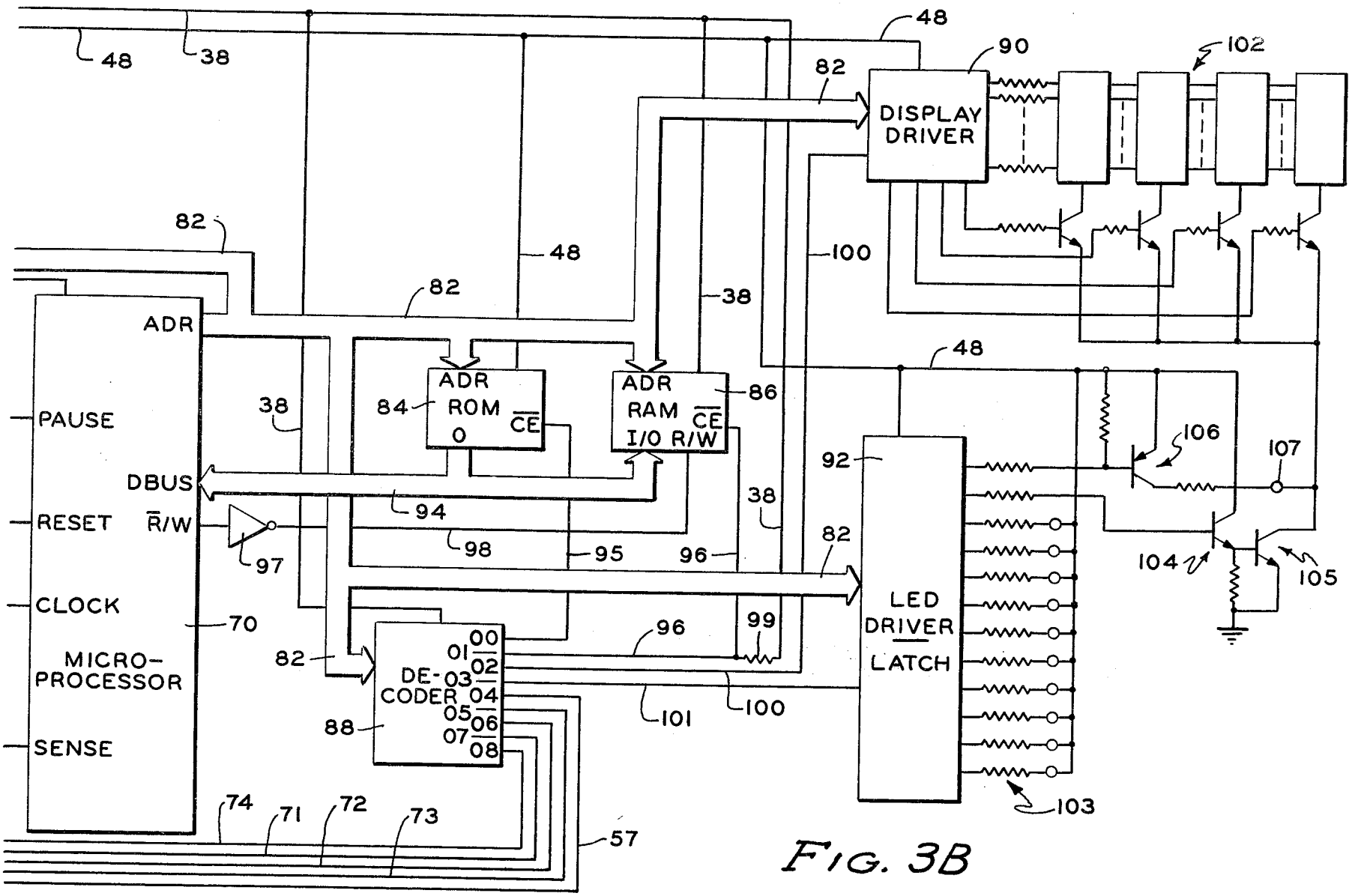

The internal circuitry of the time logging apparatus of FIGS. 1 and 2 is shown in detail in FIGS. 3A and 3B. Reference numeral 30 identifies a source of 60 cycle per second alternating current, such as commonly available from a public utility. The current from source 30 is supplied through a primary winding 31 of a transformer whose secondary winding 32 is connected to ground through a center tap 33. The opposite ends of secondary winding 32 are connected to the anodes of a pair of diodes 34 and 35 arranged to achieve half-wave rectification.

The cathodes of diodes 33 and 34 are connected to the inputs of a pair of commercially available voltage regulators 36 and 37, such as those identified by National Semiconductor Corporation numbers LM341P-5 and LM309K respectively. Voltage regulator 36 supplies electrical power at five volts through a conductor 38 to a random access memory (RAM) and an associated decoder as will be described hereinafter, and also functions to maintain a charge in a battery 39 which is connected between ground and the output terminal of the voltage regulator through a resistor 40. A capacitor 41 is connected across series connected battery 39 and resistor 40. A diode 42 is connected across resistor 40. Voltage regulator 36, battery 39 and the associated circuitry cooperate to ensure continuous voltage on conductor 38 sufficient to prevent the loss of data in the event of failure of source 30 for up to several hours. Reference numerals 43 and 44 identify filter capacitors associated with voltage regulator 37 which supplies operating power for all components except the previously mentioned RAM and decoder.

The time logging apparatus is based on a microprocessor which, in the event of a power failure, must be shut down in an orderly manner. Impending power failure is sensed by circuitry 45, including a zener diode voltage reference 46 and Schmidt trigger circuit 47. The output signal of Schmidt trigger circuit 47 is supplied to the microprocessor through a conductor 49, and is utilized as will be described hereinafter.

A timing signal is derived from the alternating voltage at one end of secondary winding 32 by means of a commercially available timer chip 50 and associated input circuitry 51. One suitable timing device is a Signetics, Inc. 555 Timer which produces a positive going pulse of about fourteen milliseconds duration every sixteen milliseconds. The output signal of timer 50 is supplied to a pair of interconnected NAND gates 53 and 54 which produce a one microsecond negative going pulse every sixteen milliseconds. The latter signal is utilized to set a flip-flop 55 whose output signal appears on a conductor 56. The output signal of flip-flop 55 is set low every sixteen milliseconds, and reset at the same frequency by a strobe signal on a conductor 57.

Reference numerals 60, 61 and 62 identify commercially available eight input multiplexers which accept timing signals from flip flop 55 and input signals from a plurality of switches 52. Suitable multiplexers are manufactured by Motorola, Inc., and designated at Type SN57151. With reference to FIG. 1, switches 52 correspond to the keyboard keys, ON-OFF switch 15 and display mode switch 16. The key switches may be momentary contact switches. One side of each switch is connected to ground, and the other side is connected to a separate data input terminal on one of multiplexers 60–62. Each data input terminal is connected to the output terminal of voltage regulator 37 through a resistor. Accordingly, the multiplexer input terminals are maintained at a high voltage state except when the switches are closed.

The input switch identified by reference numeral 58 corresponds to ON-OFF switch 15. An indicator lamp 59, which may correspond to the lower dot illustrated on display 13 in FIG. 1, is connected between voltage regulator 37 and one side of switch 58. Accordingly, lamp 59 (lower dot in display 13) is lit when switch 58 is closed to turn the time logging apparatus ON.

Multiplexers 60–62 each have a data output terminal labeled "Z". They also each have a strobe terminal labeled "$\overline{S}$" and address terminals labeled "ADR" for receiving an address which determines from which input terminal data will be transmitted to the output terminal. The data output terminals are connected through NOR gates 63–65, each having two inputs, a three input NOR gate 66 and a flip-flop 67 to a SENSE terminal of a microprocessor 70. For purposes of the following description, microprocessor 70 is assumed to be a Signetics 2650 Microprocessor which has PAUSE, RESET, CLOCK, address bus (ADR), data bus (DBUS) and read/write ($\overline{R}$/W) terminals, in addition to the SENSE terminal.

Interconnected NOR gates 63–66 effectively serve to permit additional addressing so that at any one time only data from a single desired input terminal is passed to microprocessor 70. Three multiplexers and four NOR gates are shown for achieving the multiplexing function only to illustrate one satisfactory implementation. A single multiplexer having more data input and address terminals could be used equally as well.

One input of each of NOR gates 63–65 and the strobe terminal on each of multiplexers 60–62 is supplied with a strobe signal. Specifically, the strobe signal for multiplexer 60 and NOR gate 63 is supplied on a conductor 71. The strobe signal for multiplexer 61 and NOR gate 64 is supplied on a conductor 72. The strobe signal for multiplexer 62 and NOR gate 65 is supplied on a conductor 73. Thus, the strobe signals on conductors 71–73 provide for selectively enabling the multiplexers and, in part, determine which one of switches 52 is permitted to control the state of the signal supplied to the SENSE terminal of microprocessor 70 at any one time. NOR gate 66 provides for interconnecting the output terminals of NOR gate 63–65. Flip-flop 67, which is supplied with a strobe signal on conductor 74, provides for synchronizing the input data, i.e., keeping the signal at the SENSE terminal in its proper state until it can be accepted by microprocessor 70.

The signal on conductor 49 is supplied to the PAUSE terminal of microprocessor 70 through a pair of series connected inverters 75 and 76. Inverters 75 and 76 function to introduce a short delay into the signal on conductor 49 generated by an impending failure of the primary power source. The delayed signal is further inverted by means of an inverter 77 and an associated resistor-diode-capacitor network and supplied to the RESET terminal of microprocessor 70. The signals supplied to the PAUSE and RESET terminals through inverters 75–77 cause operation of microprocessor 70 to be shut down in an orderly manner in the event of failure of the primary power source.

A clock signal for microprocessor 70 is produced by an inverter 78 and an associated resistor-capacitor network comprising a resistor 79 connected between the output and input terminals of the inverter and a capacitor 80 connected between the input terminal and ground. In one satisfactory embodiment, the resistance and capacitance values were chosen to achieve oscillation at a frequency between 600,000 and 700,000 cycles per second. However, the applicant's time logging apparatus is capable of satisfactory operation over a substantially wider range of clock frequencies.

Microprocessor 70 is programmed as will hereinafter be described to generate addresses and maniplate data as required. Address words are supplied over an address bus 82 to multiplexers 60–62, a read only memory (ROM) 84, a random access memory (RAM) 86, a decoder 88, a display driver 90 and a LED driver/latch 92. ROM 84 and RAM 86 are connected to data terminals of microprocessor 70 through a data bus 94. ROM 84 contains the program for microprocessor 70, and, in response to an address on bus 82, supplies a corresponding instruction to the microprocessor over bus 94. A single block labeled ROM is shown for simplicity. However, the ROM may actually be implemented with several identical coordinately addressed ROM chips. Strobe signals supplied over conductors represented by line 95 selectively enable the appropriate chip.

Similarly, in response to an address on bus 82, and strobe signals on conductors represented by line 96, RAM 86 which may be implemented with several RAM chips, stores data from or supplies data to microprocessor 70 over data bus 94. Storing of data in RAM 86 is effected by means of a write signal supplied to the RAM from microprocessor 70 through an inverter 97 and a conductor 98. RAM 86 obtains its power from voltage regulator 36 and/or battery 39 to prevent the loss of stored data in the event of failure of the primary power source. The voltage at the enabling terminal of the RAM is also prevented from unintentionally dropping by connecting the enabling terminal to conductor 38 through a resistor 99.

Decoder 88 is utilized to supply the strobe signals on conductors 57, 71–74, 95 and 96, in addition to supplying strobe signals to display driver 90 and LED driver/-latch 92 over conductors 100 and 101 respectively. The strobe signals are generated in response to address words provided by microprocessor 70. Decoder 88 may be implemented with several decoder chips, such as SN74LS138 data selectors/multiplexers manufactured by Texas Instruments, Inc. Power for the decoder is supplied by voltage regulator 36 and/or battery 39 to further insure against loss of data stored in RAM 86.

Display driver 90 responds to address words on address bus 82 and strobe signals on conductor 100 by appropriately activating a four digit display assembly 102. Microprocessor 70 is programmed so that the address words result in displaying of numerals which represent time intervals in accordance with the account and function keys which have been actuated.

Certain output terminals of LED driver/latch 92 are connected to a plurality of indicator lamps 103 corresponding to indicator lamps 12 in FIG. 1. Microprocessor 70 is programmed to supply address words which cause driver/latch 92 to illuminate indicator lamps 103 for those accounts having activity associated therewith at any time. Driver/latch 92 may be implemented with 74LS259 chips manufactured by Texas Instruments, Inc.

Two additional output terminals of driver/latch 92 are connected to circuitry, including transistors 104, 105 and 106, which provides for illuminating an indicator lamp 107 corresponding to the upper dot shown in display 13 in FIG. 1. Lamp 107 is lit when the display mode for displaying time in hours and minutes is selected. Functioning of lamp 107 is coordinated with functioning of display assembly 102 so that when the lamp is lit the proper set of numerals is displayed on the display assembly.

Figure 4:
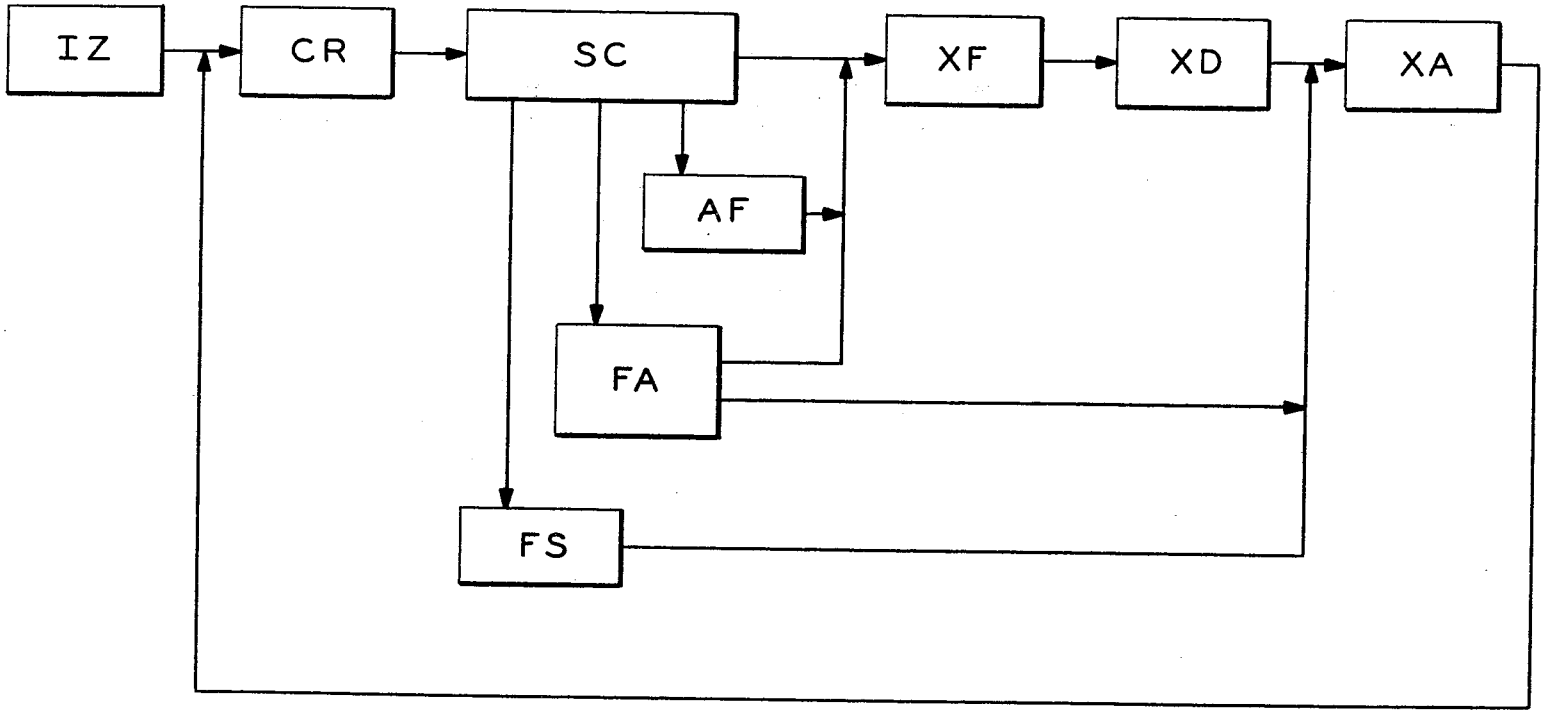
FIG. 4 is a block diagram showing the organization of principal microprocessor routines performed in the time logging apparatus of FIGS. 1-3.
Figure 5A:
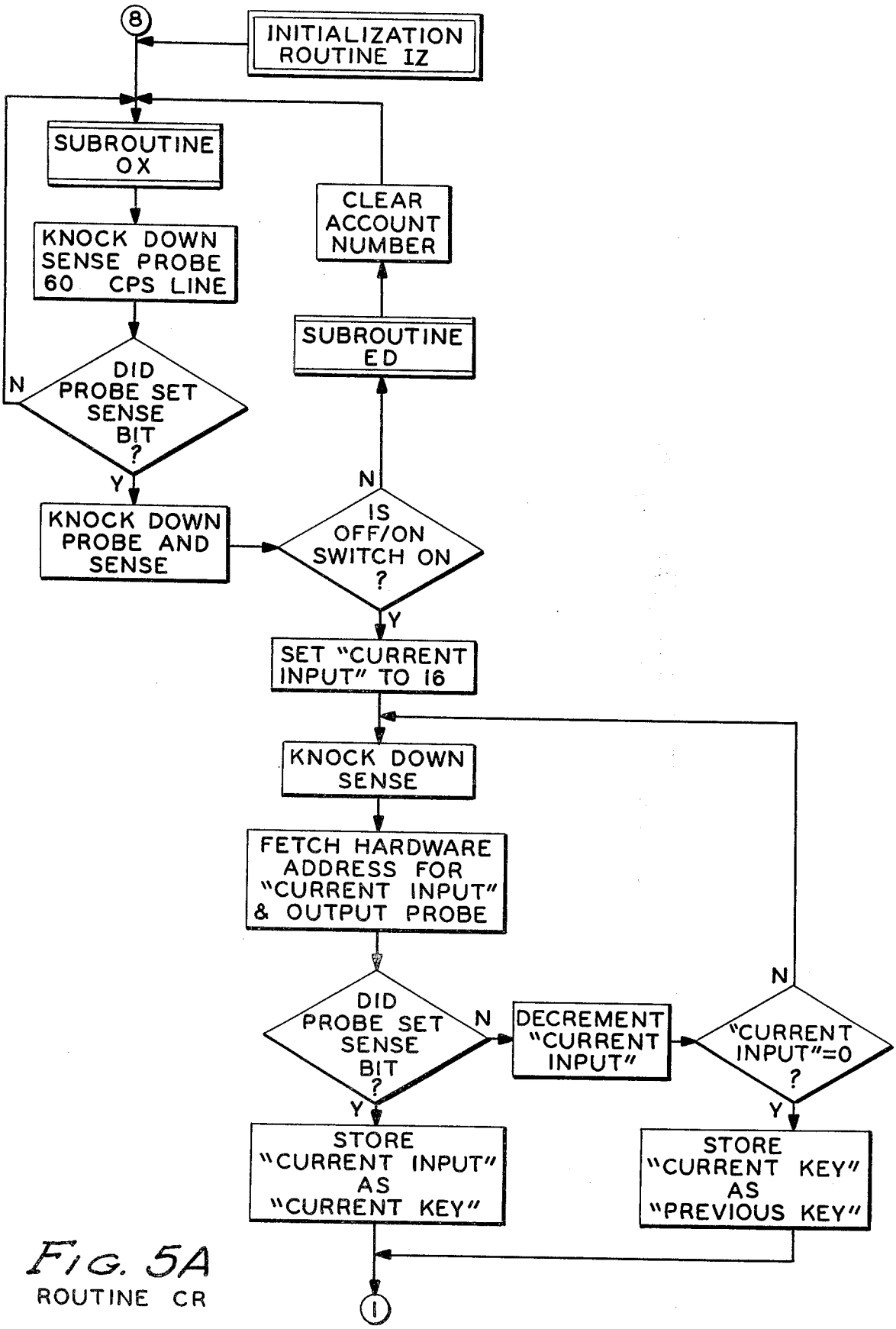
Figure 5B:
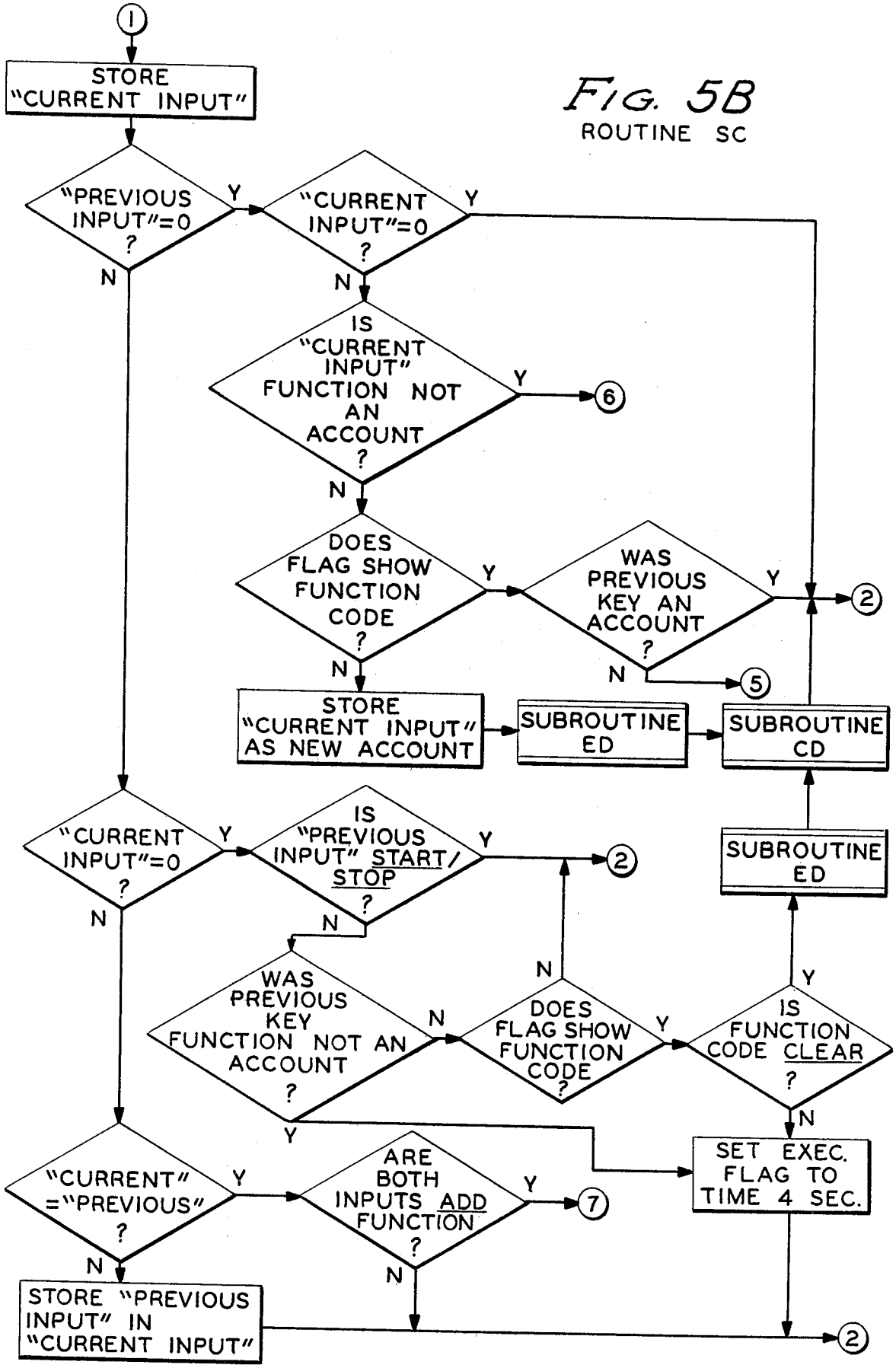
Figure 5C:
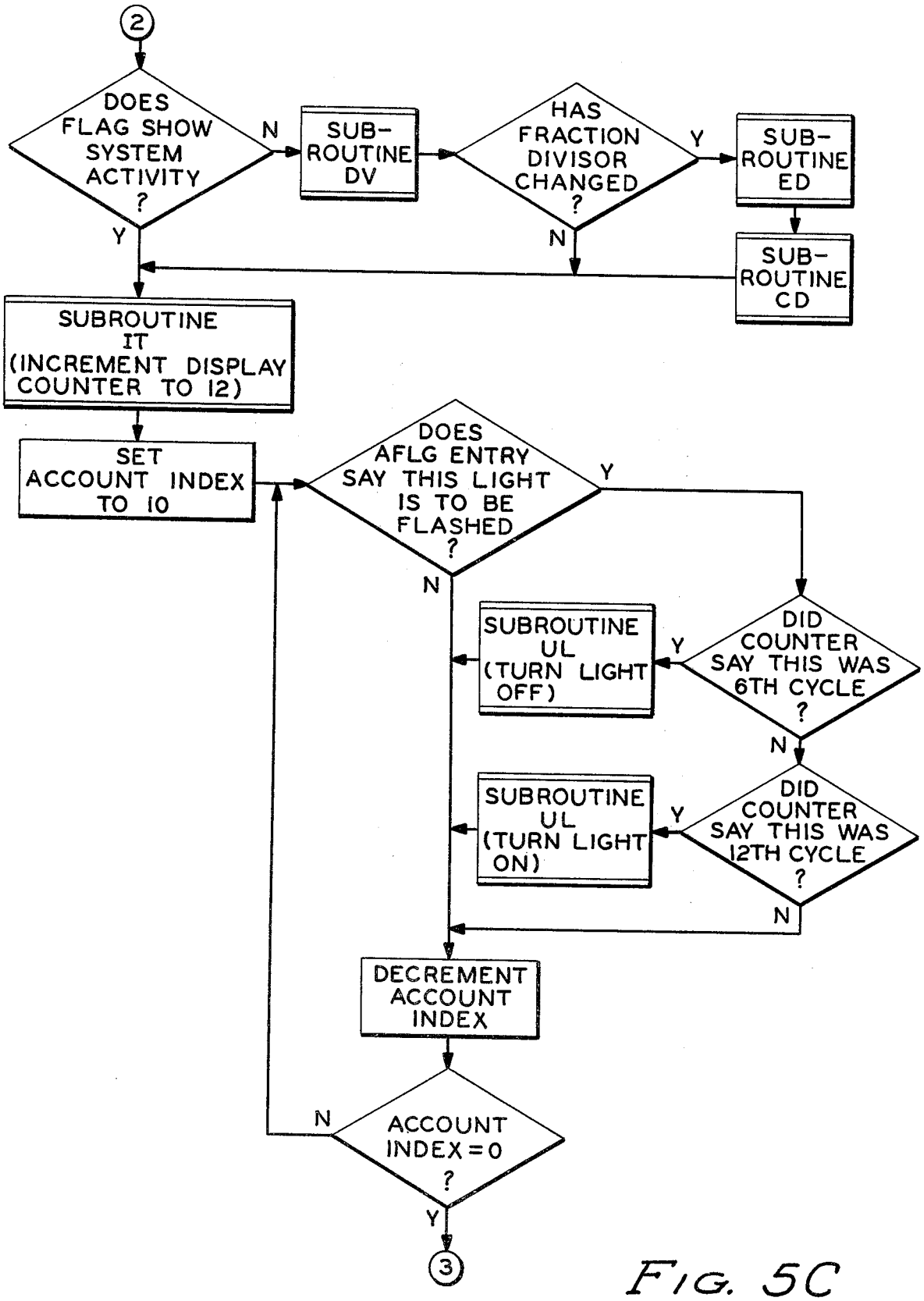
Figure 5D:
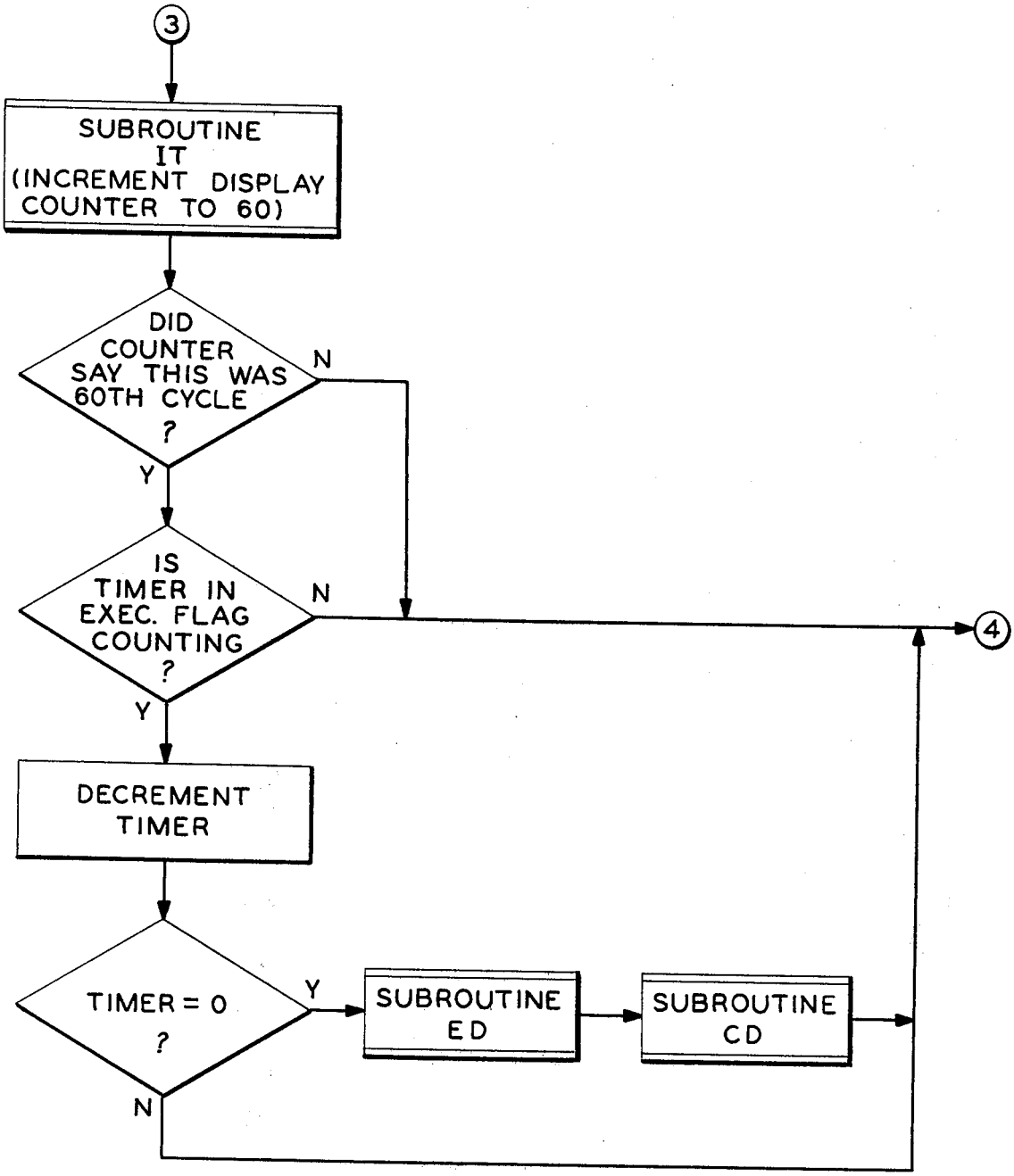
Figure 5E:
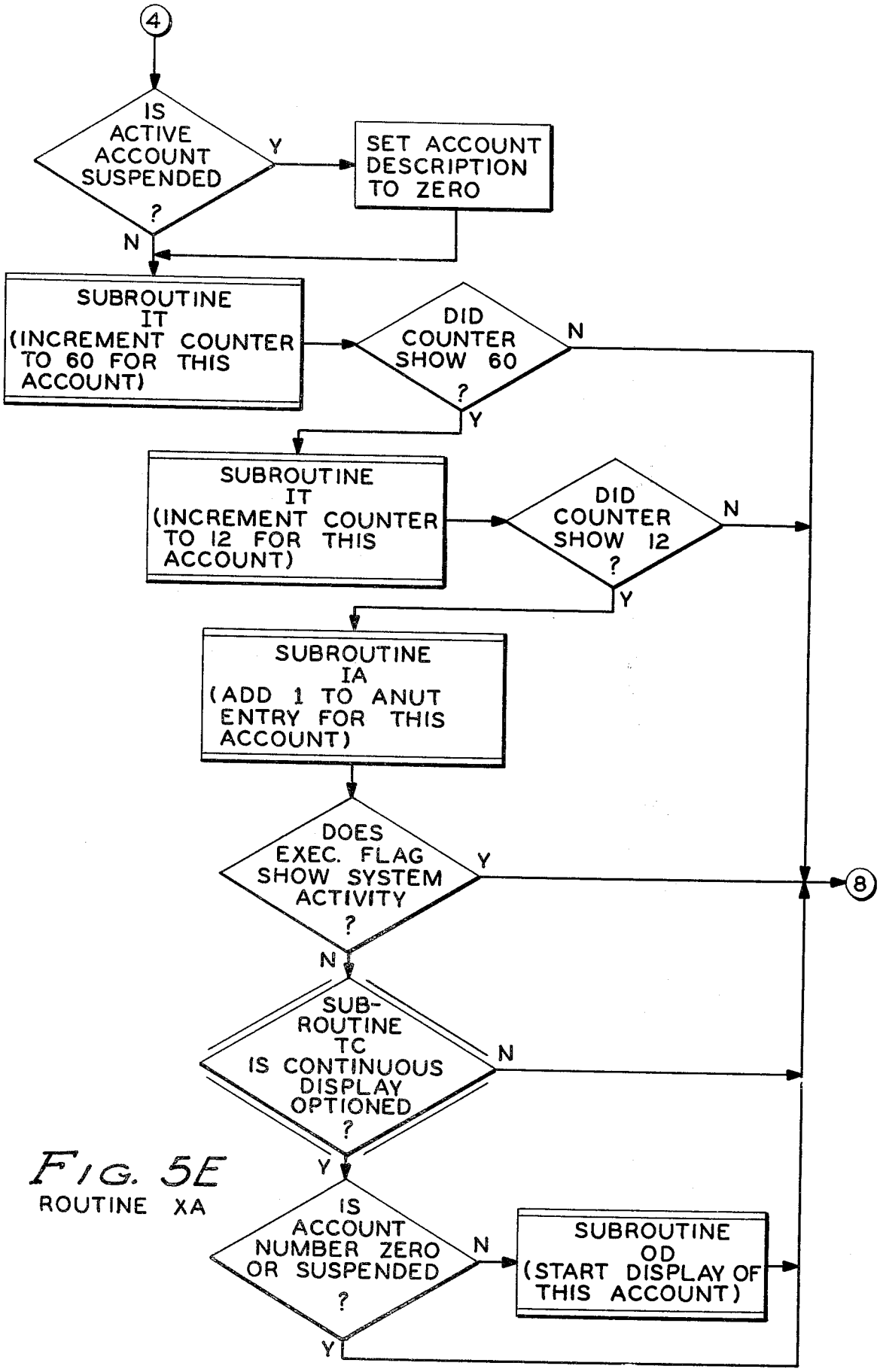
Figure 5F:
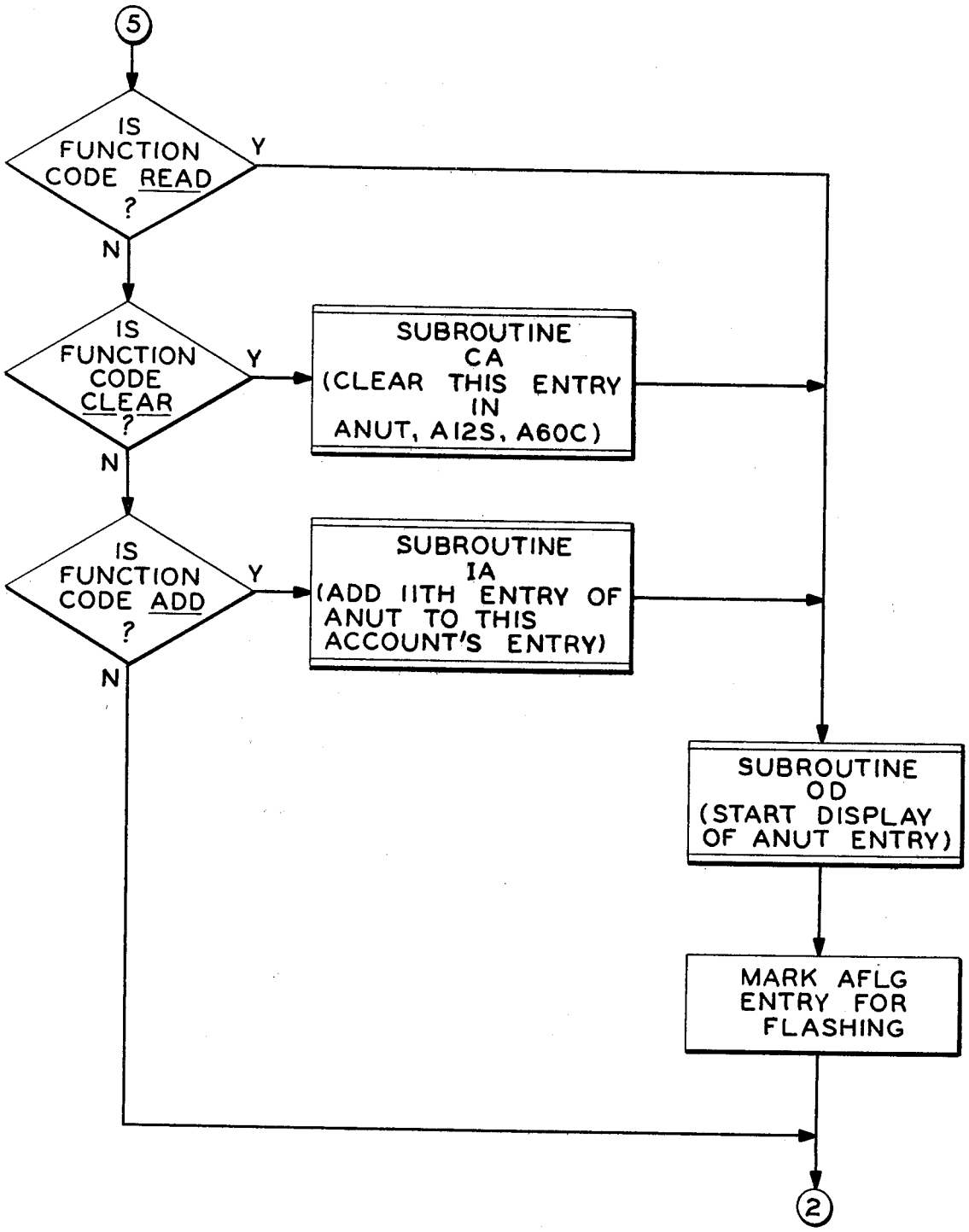
Figure 5G:
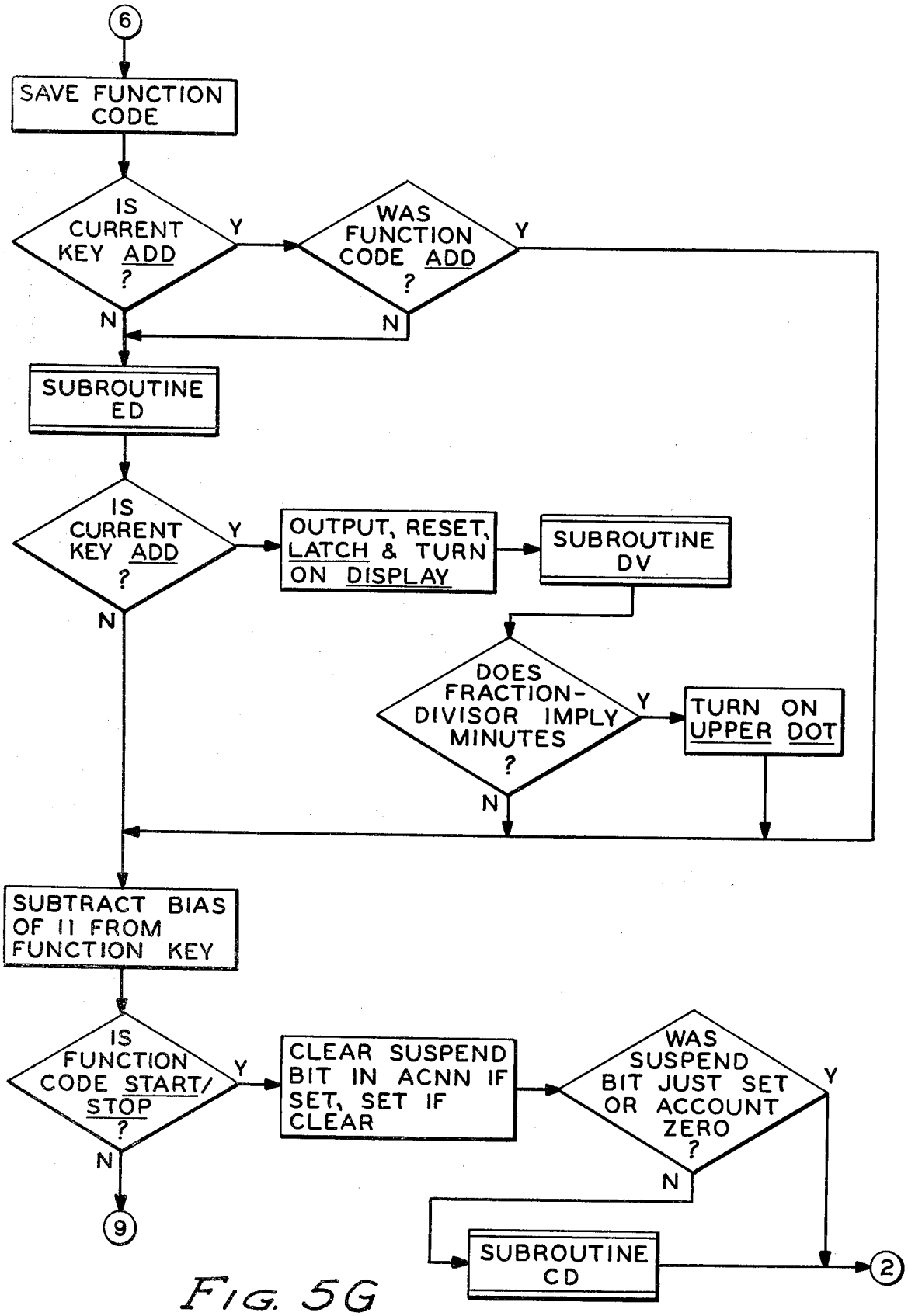
Figure 5H:
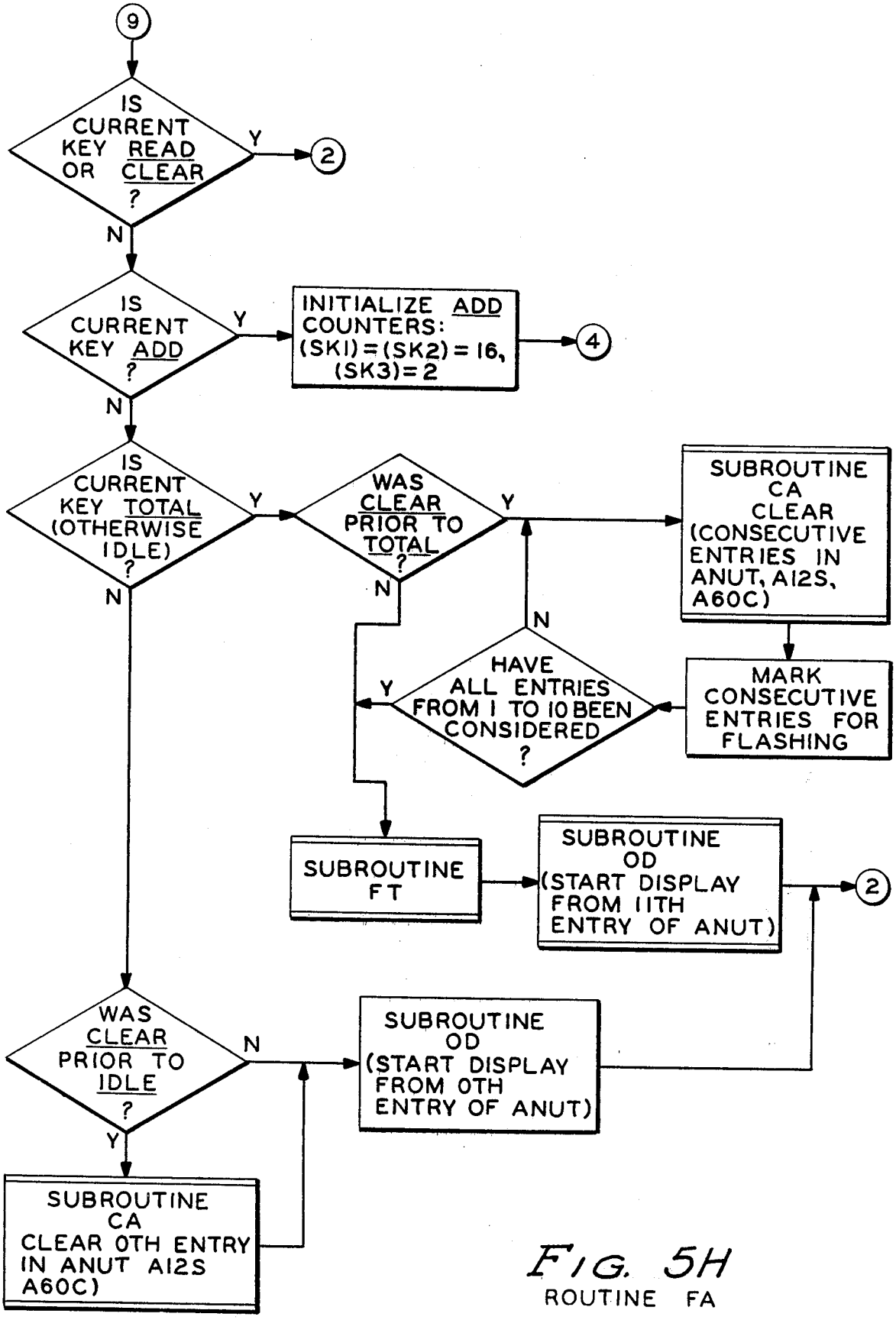
Figure 51:
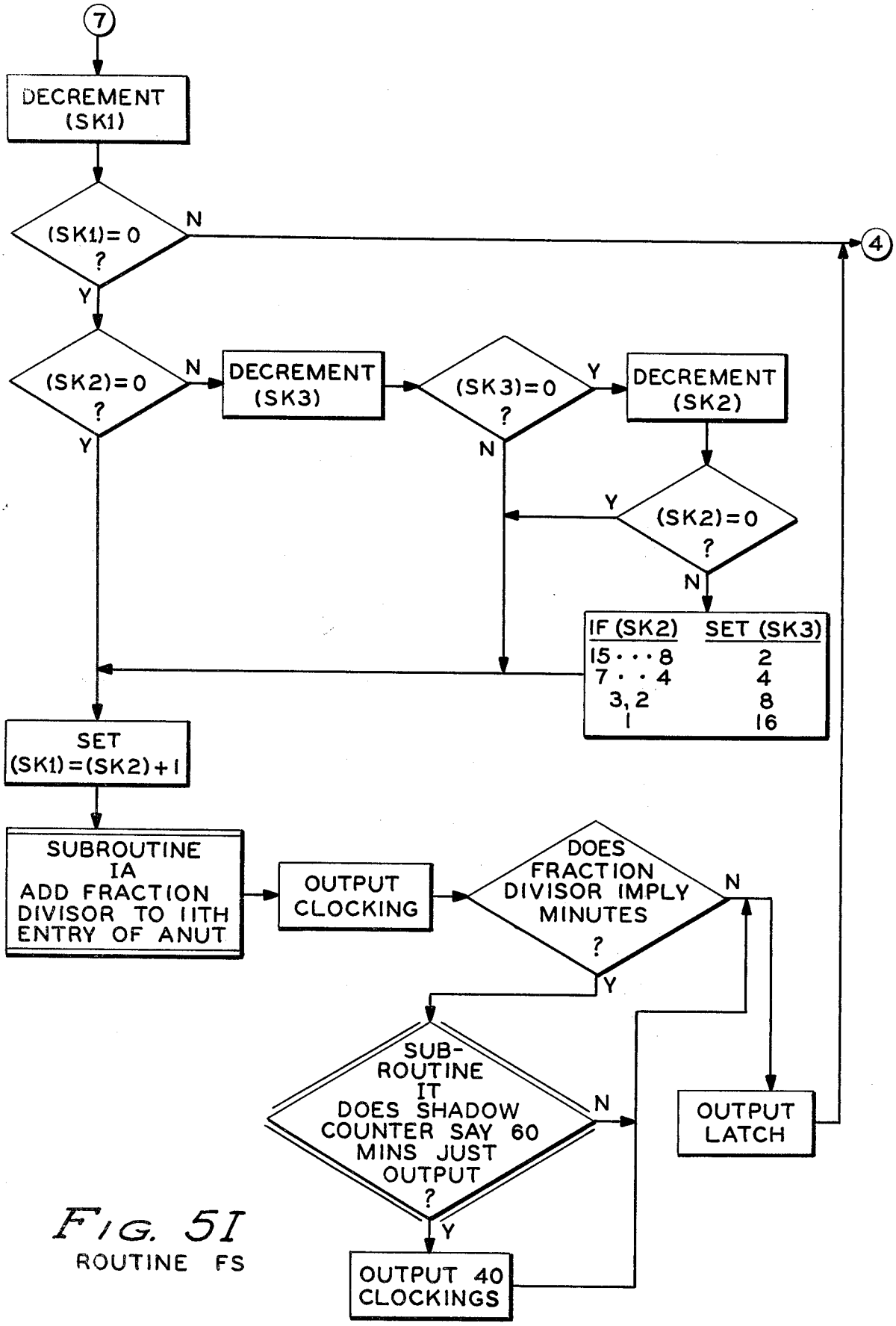

A general organization of the principal routines which microprocessor 70 is programmed to perform is diagrammed in FIG. 4. FIGS. 5A–5I comprise a flow diagram for the principal routines. A program listing of the complete microprocessor program is given Appendix A. The listing contains headings to identify the various sets of instructions corresponding to the routines identified in FIGS. 4 and 5.

Figure 6:
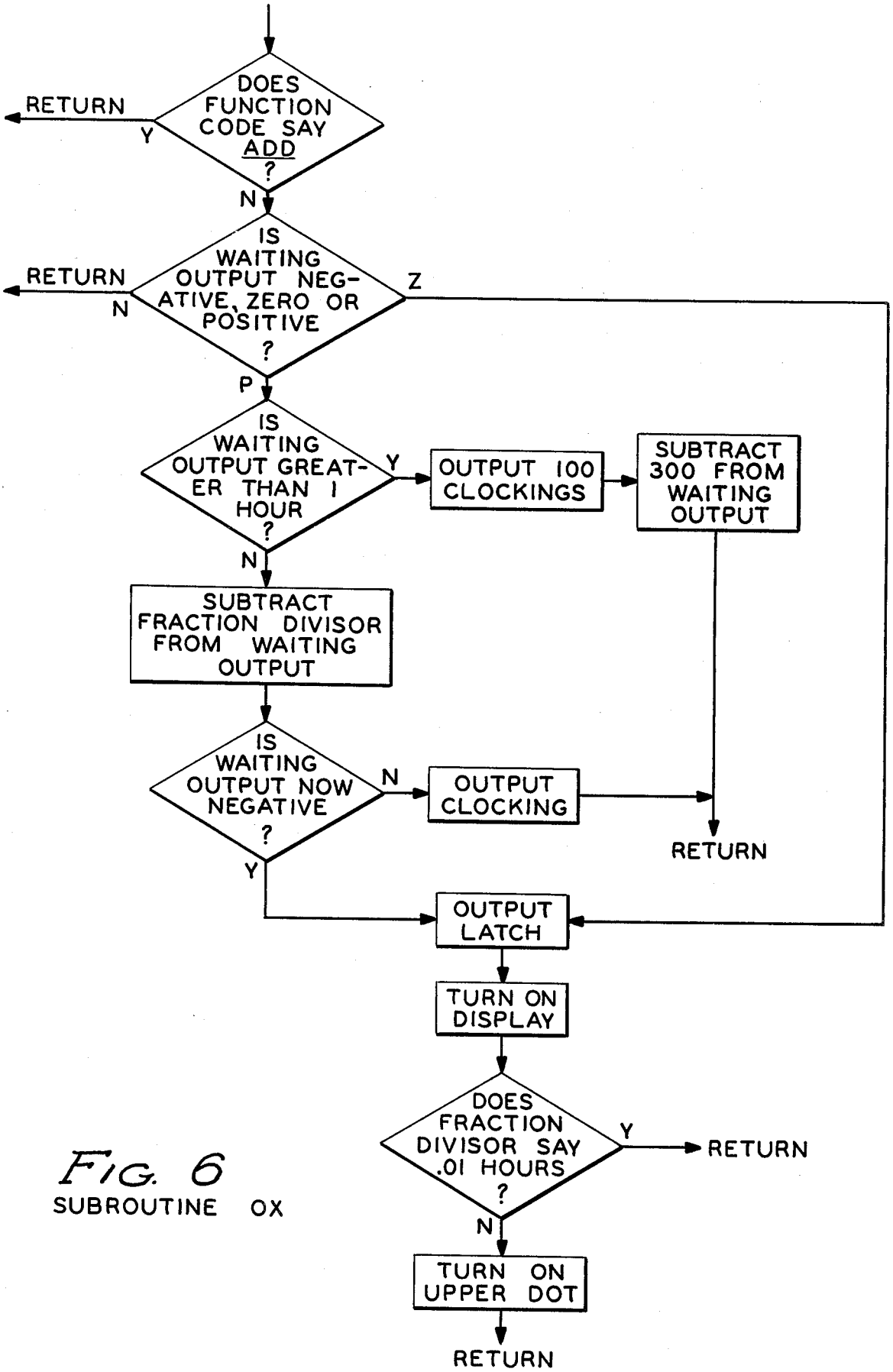
FIG. 6 is a flow diagram for one of the subroutines utilized in the routine of FIG. 5A.

Certain blocks in the flow diagrams of FIG. 5A–5I are labeled subroutines. Appendix B contains program listings for the subroutines. FIG. 6 is a flow diagram for subroutine OX, the longest of the subroutines.

As set forth in detail hereinbefore, the applicant has provided improved microprocessor based time logging apparatus. The apparatus is compact, structurally simple, and characterized by an exceptionally simple data entry and retrieval format. In spite of its structural and functional simplicity, the apparatus offers considerable operational flexibility and time data manipulation capability. Although only a single embodiment is shown and described in detail, it will be apparent to those skilled in the art that various modifications and changes can be made without departing from the applicant's contemplation and teaching. Accordingly, the coverage sought for the present invention is not limited to the particular embodiment shown, but only by the terms of the appended claims.

APPENDIX A

START OF MEMORY

```
e   300   9b  ZBRR    *JIZ        Go to initialization.
a   301   90
                                  INITIALIZATION
e   360*  20  EORZ    0           Clear (R0).
          92  LPSU                Clear program state words.
          93  LPSL
          bb  ZBSR    *JED        Subroutine-branch to ED to clear lights,
as        a4                      display, flag, unprotected RAM.
          bb  ZBSR    *JCD        Subroutine-branch to CD to light account
as        a6                      start display if optioned.
          20  EORZ    0           Clear (R0).
          cc  STRA,0  PKEY        Clear (PKEY) and (INPD).
m         04
          2b
          cc  STRA,0  INPD
m         04
          31
          9b  ZBRR    *JCR        Exit to CR.
ax  36f*  92
                                  ROUTINE CR
e   370*  20  EORZ    0           Clear (R0) and the upper status word.
          92  LPSU
          bb  ZBSR    *JOX        Go continue any active output.
as        a0
          c8  STRR    *CR5+1      Output knockdown to SENSE.
hr        aa
          cc  STRA    H'800'      Output probe to 60-CPS line.
h         08
          00
          b4  TPSU    H'80'       Is 60-CPS pulse set?
          80
          98  BCFR,E  CR          Branch if 60-CPS pulse not set.
r         73
```

-continued

```
                cc  STRA      H'f00'        Output knockdown to 60-CPS pulse.
h               0f
                00
        380*    c8  STRR      *CR5+1        Output knockdown to SENSE.
hr              9e
                cc  STRA      H'a03'        Does OFF/ON say ON?
h               0a
                03
                b4  TPSU      H'80'
                80
                18  BCTR,E    CR1           Branch if ON; otherwise OFF.
r               08
                bb  ZBSR      *JED          Subroutine-branch to ED to clear lights,
as              a4                          display, flag, unprotected RAM.
                20  EORZ      0             Clear (R0) and account number.
                cc  STRA,0    ACNN
m               04
                00
                1b  BCTR,U    CR            Continue at CR.
r       390*    5f
                05  LODI,1    32            Prepare (R1) as index to test for new
                20                          input.
                0d  LODA,0    IDAT+0,1      Set (IA0,IA1) to location of input
m               60                          address of key indexed by (R1).
                38
                cc  STRA,0    IA0
m               04
                2e
                0d  LODA,0    IDAT+1,1
m               60
                39
                cc  STRA,0    IA1
m               04
                2f
                cc  STRA      H'e00'        Output knockdown to SENSE.
h       3a0*    0e
                00
                cc  STRA      *IA0          Address input address lines.
hm              84
                2e
                b4  TPSU      H'80'         Is SENSE bit set by probe?
                80
                18  BCTR,E    CR2           Branch if SENSE bit set.
r               04
                a5  SUBI,1    2             Otherwise decrement index.
                02
                59  BRNR,1    CR4           Branch unless index has decremented
r               66                          to zero.
                51  RRR,1                   Convert index in R1 to "current input."
                18  BCTR,Z    CR3           Branch when zero input over storing of
r               04                          nonzero input.
        3b0*    c9  STRR,1    *CR3+1        If input not zero, store input in CKEY.
mr              83
                1b  BCTR,U    CR6           Continue at SC.
r               06
                0c  LODA,0    CKEY          If input is zero, place "current key"
m               04                          in "previous key."
                2a
                cc  STRA,0    PKEY
m               04
                2b
                9b  ZBRR      *JSC          Continue at SC.
ax      3bb*    b0
                                            ROUTINE SC
e       3c0*    0c  LODA,0    INPD          Set (R0) to previous input.
m               04
                31
                c9  STRR      *SC+1         Store (R1) away as current input.
mr              fc
                58  BRNR,0    SC6           Branch if previous input was nonzero.
r               20
                e1  COMZ      1             Are both current and previous inputs 0?
                18  BCTR,Z    SC5           Branch if both zero to exit to XF.
r               1b
                e5  COMI,1    10            Is current input account or function?
                0a
                99  BCFR,P    SC2           Branch if account; otherwise function.
r               02
                9b  ZBRR      *JFA          If function, exit to FA.
ax              9e
        3d0*    02  LODZ      2             Does exec flag show a function code?
                44  ANDI,0    7
```

-continued

```
          07
          99  BCFR,P   SC1        Branch unless flag shows a function code
r         09
          0f  LODA,3   PKEY       Set (R3) to previous key.
m         04
          2b
          e7  COMI,3   10         Was previous key also an account?
          0a
          99  BCFR,P   SC5        Branch if prior account to exit at XF.
r         09
          9b  ZBRR     *JAF       Otherwise exit to AF.
ax        9a
          cd  STRA,1   ACNN       Store account in ACNN.
m         04
    3e0*  00
          bb  ZBSR     *JED       Subroutine-branch to ED to clear lights,
as        a4                      display, flag, unprotected RAM.
          bb  ZBSR     *JCD       Subroutine-branch to CD to light account
as        a6                      start output if so optioned.
          9b  ZBRR     *JXF       Exit to XF.
ax        94
          59  BRNR,1   SC8        Branch if current input is not zero.
r         17
          e4  COMI,0   11         Was previous input START/STOP?
          0b
          18  BCTR,E   SC5        Branch if START/STOP to XF.
r         78
          19  BCTR,P   SC4        Branch if any other function to time
r         09                      4 seconds (Otherwise account).
          02  LODZ     2          Does exec flag show a function code?
    3f0*  44  ANDI,0   7
          07
          18  BCTR,Z   SC9        Branch if no function code to XF.
r         18
          e4  COMI,0   2          Is function code CLEAR?
          02
          18  BCTR,E   SC3        Branch if CLEAR.
r         69
          66  IORI,2   H'40'      Otherwise set timer for 4 seconds.
          40
          20  EORZ     0
          cc  STRA     D60C       Also clear counter-to-60-cycles for
m         04                      displays.
          64
          9b  ZBRR     *JXF       Exit to XF.
ax        94
    400*  e1  COMZ     1          Does current input = previous?
          98  BCFR,E   SC7        Branch if not equal.
r         06
          e5  COMI,1   H'0e'      Are both current and previous inputs
          0e                      ADD?
          98  BCFR,E   SC9        Branch if both not ADD to exit to XF.
r         05
          9b  ZBRR     *JFS       Branch if both ADD to FS.
ax        9c
          cc  STRA,0   INPD       Store "previous input" also as "current"
m         04
          31
          9b  ZBRR     *JXF       Exit to XF.
ax  40d*  94
                                  ROUTINE XF
e   41d*  02  LODZ     2          Does exec flag show function or timing?
          44  ANDI,0   H'77'
          77
          98  BCFR,E   XF1        Branch if so.
r         0e
          77  PPSL     H'10'      Set register-bank to 1.
          10
          01  LODZ     1'         Set (R0) to fraction-divisor.
          bb  ZBSR     *JDV       Subroutine-branch to DV to place new
as        aa                      fraction-divisor in R1'.
          e1  COMZ     1'         Has fraction'divisor changed?
          75  CPSL     H'10'      Set register-bank to 0, regardless.
          10
          18  BCTR,E   XF1        Branch if the fraction-divisor has
r         04                      changed.
          bb  ZBSR     *JED       Subroutine-branch to ED to clear lights,
as  42d*  a4                      display, flag, unprotected RAM.
          bb  ZBSR     *JCD       Subroutine-branch to CD to light account
as        a6                      start display if so optioned.
          04  LODI,0   <<D12C     Prepare to increment counter-to-12
m         62                      cycles.
```

-continued

```
        05  LODI,1   12
        0c
        bb  ZBSR     *JIT        Subroutine-branch to IT to increment
as      b4                       counter-to-12 cycles.
        c1  STRZ     1           Set (R1) to returned counter.
        07  LODI,3   10          Set (R3) to index account flags.
        0a
        0f  LODA,0   AFLG,3      Does this flag say this light to be
m       64                       flashed?
        40
        18  BCTR,E   XF5         Branch if not to be flashed.
r  43d* 0b
        04  LODI,0   8           Prepare to turn off this light by
        08                       setting (R0) = 8.
        e5  COMI,1   6           Is this the 6th cycle?
        06
        18  BCTR,E   XF4         Branch if so to turn light off.
r       03
        20  EORZ     0           Otherwise prepare to turn light on.
        59  BRNR,1   XF5         Branch if not the 12th cycle.
r       02
        bb  ZBSR     *JUL        Subroutine-branch to UL to turn light
as      ae                       off or on, according to (R0).
        fb  BDRR,3   XF3         Branch unless all lights considered.
r       6e
        9b  ZBRR     *JXD        Continue at XD.
ax 44c* 96
                                 ROUTINE XD
e  450* 04  LODI,0   <<D60C      Prepare to increment counter-to-60-
m       64                       cycles.
        05  LODI,1   60
        3c
        bb  ZBSR     *JIT        Subroutine-branch to IT to increment
as      b4                       counter-to-60-cycles.
        58  BRNR,0   XD2         Branch if not 60th cycle to exit to XA.
r       0f
        02  LODZ     2           Set (R0) to exec flag in R2.
        44  ANDI,0   H'70'       Is timer counting?
        70
        18  BCTR,Z   XD2         Branch if timer not counting.
r       0a
        a6  SUBI,2   H'10'       Otherwise decrement timer.
        10
        a4  SUBI,0   H'10'
   460* 10
        58  BRNR,0   XD2         Branch if timer not decremented to
r       04                       to zero.
        bb  ZBSR     *JED        Subroutine-branch to ED to clear display
as      a4                       lights, flag, unprotected RAM.
        bb  ZBSR     *JCD        Subroutine-branch to CD to light account
as      a6                       start output if so optioned.
        9b  ZBRR     *JXA        Continue at XA.
ax 468* 98
                                 ROUTINE XA
e  46c* 0f  LODA,3   ACNN        Set (R3) to the active account number.
m       04
        00
        9a  BCFR,N   XA1         Branch if suspend bit is clear.
r       02
        07  LODI,3   0           If suspended, clear (R3).
        00
        04  LODI,0   <<A60C      Prepare to increment counter-to-60
m       34                       cycles for this account.
        83  ADDZ     3
        05  LODI,1   60
        3c
        bb  ZBSR     *JIT        Subroutine-branch to IT to increment
as      b4                       counter-to-60-cycles, or 1 second.
        58  BRNR,0   XA4         Branch if returned counter does not
r       1f                       show 60 cycles, or 1 second.
   47c* 04  LODI,0   <<A12C      Prepare to increment counter-to 12-
m       1a                       seconds for this account.
        83  ADDZ     3
        05  LODI,1   12
        0c
        bb  ZBSR     *JIT        Subroutine-branch to IT to increment
as      b4                       counter-to-12-seconds.
        58  BRNR,0   XA4         Branch if returned counter does not
r       16                       show 12 seconds.
        03  LODZ     3           Otherwise set (R1) to account number.
        c1  STRZ     1
        07  LODI,3   1           Prepare to add 1 to appropriate ANUT
```

-continued

```
                01                                  entry.
                20  EORZ     0
                bb  ZBSR     *JIA                   Subroutine-branch to IA to add (R0,R3)
as              ac                                  to ANUT + 2*(R1).
     48c*       02  LODZ     2                      Does exec flag show function or timing?
                44  ANDI,0    H'f7'
                f7
                98  BCFR,E   XA4                    Branch if so.
r               0a
                bb  ZBSR     *JTC                   Otherwise subroutine-branch to TC
as              b2                                  to test for continuous display.
                1a  BCTR,N   XA4                    If not optioned, return to idle routine.
r               06
                09  LODR,1   *XA+1                  Set (R1) to account number.
mr              d6
                99  BCFR,P   XA4                    Branch if zero or negative, that is,
r               02                                  suspended.
                bb  ZBSR     *JOD                   Otherwise subroutine-branch to OD
as              a8                                  to start new display.
                9b  ZBRR     *JCR                   Return to idle routine.
ax   49c*       92
                                        ROUTINE AF
e    4a0*       e4  COMI,0   2                      is function READ, CLEAR, or ADD?
                02
                1a  BCTR,N   AF3                    Branch if READ.
r               12
                98  BCFR,E   AF2                    Branch if not CLEAR.
r               04
                bb  ZBSR     *JCA                   Subroutine-branch to CA to clear (R1)th
as              b6                                  entry in ANUT, A12S, and A60C.
                1b  BCTR,U   AF3                    Continue at AF3.
r               0c
                e4  COMI,0   3                      Is function ADD?
                03
                19  BCTR,P   AF4                    Branch if not ADD.
r               10
                0c  LODA,0   ANUT+22                Set (R0,R3) to contents of 11th entry
m               04                                  in ANUT.
     4b0*       17
                0f  LODA,3   ANUT+23
m               04
                18
                bb  ZBSR     *JIA                   Subroutine-branch to IA to add (R0,R3)
as              ac                                  to ANUT + 2*(R1).
                bb  ZBSR     *JOD                   Subroutine-branch to OD to start output
as              a8                                  to display.
                02  LODZ     2
                cd  STRA,0   AFLG,1                 Mark AFLG entry nonzero for flashing.
m               64
                40
                46  ANDI,2   H'8f'                  Clear exec flag of timer.
                8f
                9b  ZBRR     *JXF                   Exit to XF.
ax   4bf*       94
                                        ROUTINE FA
e    4c4*       02  LODZ     2                      Set (R0) and PWK to function/display
                44  ANDI,0   H'0f'                  in the exec flag.
                0f
                cc  STRA,0   PWK
m               04
                28
                e5  COMI,1   H'0e'                  Is current key the ADD??
                0e
                98  BCFR,E   FA0                    Branch if not ADD.
r               05
                e4  COMI,0   3                      Was function code also an ADD, but
                03                                  without any display?
                c0  nop
                18  BCTR,E   FA2                    Branch if so, bypassing call to ED,
r               1b                                  outputting RESET and LATCH.
                bb  ZBSR     *JED                   Subroutine-branch to ED to clear lights,
as   4d4*       a4                                  display, flag, unprotected RAM.
                e5  COMI,1   H'0e'                  Is this the ADD function?
                0e
                98  BCFR,E   FA2                    Branch if not ADD.
r               15
                cc  STRA     H'd06'                 Output RESET.
h               0d
                06
                cc  STRA     h'd03'                 Output LATCH.
h               0d
                03
```

-continued

```
        cc  STRA     H'c0f'      Turn on DISPLAY.
h       0c
        0f
        bb  ZBSR     *JDV        Subroutine-branch to DV to place fraction
as      aa                       divisor in R1'.
   4e4* cd  STRA,1'  SAFD        Save fraction-divisor.
m       04
        6b
        e5  COMI,1'  5           Does fraction-divisor imply minutes?
        05
        98  BCFR,E   FA2         Branch if .01-hours, not minutes.
r       03
        cc  STRA     H'c06'      Turn on UPPER DOT.
h       0c
        06
        75  CPSL     H'10'       Set register-bank to 0, if not.
        10
        a5  SUBI,1   11          Subtract bias of 11 from function
        0b                       key to form function code.
        01  LODZ     1           Store function code as exec flag
        c2  STRZ     2           in R2.
   4f4* 98  BCFR,Z   FA4         Branch if function code in not START/
r       0d                       STOP.
        0d  LODA,1   ACNN        Set (R1) to account number.
m       04
        00
        25  EORI,1   H'80'       Set suspend bit if clear, clear if set.
        80
        c9  STRR,1   *FA3+1      Store account number back in ACNN.
mr      fa
        99  BCFR,P   FA1         If account is suspended (negative) or
r       02                       zero, branch to XF.
        bb  ZBSR     *JCD        Otherwise subroutine-branch to CD to
as      a6                       light account, start display if opted.
        9b  ZBRR     *JXF        Exit to XF.
ax      94
        05  LODI,1   11          In anticipation, set ANUT index to 11.
   504* 0b
        08  LODR,0   *FA13+1     Set (R0) to previous function/display.
mr      c1
        e6  COMI,2   3           Is present key READ, CLEAR, ADD, TOTAL,
        03                       or IDLE?
        1a  BCTR,N   FA1         Branch if READ or CLEAR to XF.
r       76
        19  BCTR,P   FA6         Branch if TOTAL or IDLE; otherwise ADD.
r       0f
        07  LODI,3   16          Initialize ADD counters: (SK1) = (SK2) =
        10                       16, (SK3) = 2.
        cf  STRA,3   SK1
m       04
        66
        cf  STRA,3   SK2
m       04
   514* 67
        07  LODI,3   2
        02
        cf  STRA,3   SK3
m       04
        68
        9b  ZBRR     *JXA        Exit to XA.
ax      98
        e6  COMI,2   4           Function code says TOTAL or IDLE?
        04
        19  BCTR,P   FA16        Branch if IDLE; otherwise TOTAL.
r       14
        e4  COMI,0   2           Was CLEAR prior to TOTAL?
        02
        98  BCFR,E   FA9         Branch if not prior CLEAR.
r       0a
   524* 05  LODI,1   10          Set (R1) to index accounts.
        0a
        01  LODZ     1           Set (R0) nonzero.
        cd  STRA     AFLG,1      Mark AFLG entry nonzero for flashing.
m       64
        40
        bb  ZBSR     *JCA        Subroutine-branch to CA to clear (R1)th
as      b6                       entry in ANUT, A12S, A60C.
        f9  BDRR,1   FA8         Branch unless all 10 entries of ANUT
r       78                       considered.
        bb  ZBSR     *JFT        Subroutine-branch to FT to total ANUT
as      a2                       entries and mark flashing.
        05  LODI,1   11          Set ANUT index to 11.
```

-continued

```
          0b
          1b  BCTR,U   FA11          Continue at FA11.
r         08
    534*  05  LODI,1   0             IDLE function; set ANUT index to zero.
          00
          a4  SUBI,0   2             Was CLEAR prior to IDLE?
          02
          98  BCFR,E   FA11          Branch if not prior CLEAR.
r         02
          bb  ZBSR     *JCA          Subroutine-branch to CA to clear 0th
as        b6                         entry in ANUT, A12S, and A60C.
          bb  ZBSR     *JOD          Subroutine-branch to 0D to start display
as        a8                         from (R1)th entry of ANUT.
          9b  ZBRR     *JXF          Exit to XF.
ax  53f*  94
                                     ROUTINE FS
e   546*  77  PPSL     H'10'         Set register-bank to 1.
          10
          0d  LODA,1'  SK1           Load R1', R2', R3' with (SK1), (SK2),
m         04                         and (SK3).
          66
          0e  LODA,2'  SK2
m         04
          67
          0f  LODA,3'  SK3
m         04
          68
          a5  SUBI,1'  1             Decrement (SK1) and store back.
          01
          c9  STRR,1'  *FS11+1
mr        f4
          18  BCTR,E   FSO           Branch if (SK1) not greater than zero.
    556*  04
          75  CPSL     H'10'         Set register bank to zero.
          10
          9b  ZBRR     *JXA          Exit to XA.
ax        98
          e6  COMI,2   0             Is (SK2) already counted down to zero?
          00
          18  BCTR,Z   FS3           Branch if so.
r         0f
          a7  SUBI,3'  1             Decrement (SK3).
          01
          98  BCFR,Z   FS3           Branch if (SK3) not counted down to zero.
r         0b
          a6  SUBI,2'  1             Decrement (SK2)
          01
          18  BCTR,Z   FS3           Branch if (SK2) now zero.
r   566*  07
                If (SK2) =                        Set (SK3) =
                 15,...,8                            2
                 7,6,5,4                             4
                   3,2                               8
                     1                              16
          02  LODZ     2'            Set (R0) also to (SK2).
          07  LODI,3'  H'20'         Start (SK3) at B'0010 0000'
          20
          d3  RRL,3'
          d0  RRL,0
          9a  BCFR,N   FS2           Loop until (R3') rotates new value
r         7c                         for (SK3).
          02  LODZ     2'            Set (SK1) = (SK2) + 1.
          84  ADDI,0   1
          01
          c1  STRZ     1'
          c9  STRR,1'  *FS11+1       Replace counters SK1, SK2, and SK3.
mr        d5
          ca  STRR,2'  *FS12+1
mr        d6
    576*  cb  STRR,3'  *FS13+1
mr        d7
          75  CPSL     H'10'         Set register-bank to 0.
          10
          0f  LODA,3   SAFD          Set (R3) to fraction-divisor for this
m         04                         ADD.
          6b
          20  EORZ     0             Clear (R0).
          05  LODI,1   11            Set (R1) to index 11th entry of ANUT.
          0b
          bb  ZBSR     *JIA          Subroutine-branch to IA to add frac-
as        ac                         tion-divisor to 11th entry of ANUT.
          cc  STRA     H'd05'        Output CLOCKING.
```

-continued

```
h        0d
         05
         0b  LDRR,3   *FS4+1      Set (R3) again to fraction-divisor.
m   586* f4
         e7  COMI,3   3           Does fraction-divisor say .01-HOURS
         03                       instead of MINUTES?
         18  BCTR,E   FS8         Branch if .01-HOURS, not MINUTES.
r        0f
         04  LODI,0   <<MSKN      Prepare to add 1 to the minutes-shadow-
m        65                       counter, cycling at 60.
         05  LODI,1   60
         3c
         bb  ZBSR     *JIT        Subroutine-branch to IT to add 1 to
as       b4                       MSKN, cycling at 60.
         58  BRNR,0   FS8         Branch if returned counter in MSKN
r        07                       cycled at 60 to become 0.
         05  LODI,1   40          Otherwise prepare to output 40 CLOCKINGS
         28
         cc  STRA,0   H'd05'      Output single CLOCKING.
h   596* 0d
         05
         f9  BDRR,1   FS7         Branch unless 40 CLOCKINGS output.
r        7b
         cc  STRA     H'd03'      Output LATCH.
h        0d
         03
         9b  ZBRR     *JXA        Exit to XA.
ax  59e* 98
```

APPENDIX B

SUBROUTINE OX

```
e   5aa* 02  LODZ     2           set (R0) to the function code.
         44  ANDI,0   7
         07
         e4  COMI,0   3           Does function code say ADD?
         03
x        14  RETC,E               Return if ADD.
         77  PPSL     H'10'       Otherwise set register-bank to 1.
         10
         02  LODZ     2'          Is (R2',R3') zero or negative?
         1a  BCTR,N   OX1         Branch if negative.
r        15
         63  IORZ     3'
         18  BCTR,E   OX7         Branch if zero.
r        2f
         a7  SUBI,3'  H'2c'       Subtract H'12c' = 300 = 1 hour from
         2c                       (R2',R3').
    5ba* b5  TPSL     1           Is carry bit set, implying no borrow?
         01
         18  BCTR,E   OX9         Branch if no borrow.
r        02
         a6  SUBI,2'  1           Otherwise subtract borrow.
         01
         a6  SUBI,2'  1           Complete subtraction.
         01
         1a  BCTR,N   OX8         Branch if (R2',R3') now negative.
r        08
         04  LODI,0   100         Otherwise output 100 CLOCKINGS.
         64
         c8  STRR,0   *OX4+1      Output a single CLOCKING.
hr       9b
         f8  BDRR,0   OX0         Branch unless 100 CLOCKINGS output.
r        7c
    5ca* 1b  BCTR,U   OX6         Jump to return to pre-subroutine.
r        28
         87  ADDI,3'  H'2c'       Undo previous subtraction by adding
         2c                       H'12c' to (R2',R3').
         b5  TPSL     1           Is carry bit set ?
         01
         98  BCFR,E   OX3         Branch if carry bit not set.
r        02
         86  ADDI,2   1           Otherwise add carry.
         01
         86  ADDI,2   1           Complete addition.
         01
         03  LODZ     3'          Decrement (R2',R3') by (R1').
         a1  SUBZ     1'
         c3  STRZ     3'
         b5  TPSL     1
    5da* 01
         18  BCTR,E   OX2
r        02
         a6  SUBI,2'  1
```

-continued

```
          01
          02  LODZ     2            Is (R2',R3') still positive or zero?
          1a  BCTR,N   OX7          Branch if not positive or zero.
r         05
          cc  STRA     H'd05'       Output CLOCKING.
h         0d
          05
          1b  BCTR,U   OX6          Jump to return to pre-subroutine.
          0d
          cc  STRA     H'd03'       Output LATCHING.
h         0d
          03
    5ea*  cc  STRA     H'c0f'       Turn on DISPLAY.
h         0c
          0f
          e5  COMI,1'  3            Does fraction-divisor say .01-HOURS?
          03
          18  BCTR,E   OX6          Branch if .01-HOURS, not MINUTES.
r         03
          cc  STRA     H'c06'       Turn on UPPER DOT.
h         0c
          06
          75  CPSL     H'10'        Set register-bank to 0.
          10
x   5f6*  17  RETC,U                Return to pre-subroutine.
                          SUBROUTINE ED
e   620*  cc  STRA     H'c07'       Turn off display.
h         0c
          07
          cc  STRA     H'c0e'       Turn off upper dot.
h         0c
          0e
          20  EORZ     0            Clear (R0) and the exec flag in (R2).
          c2  STRZ     2
          77  PPSL     H'10'        Set register-bank to 1.
          10
          06  LODI,2'  H'ff'        Set (R2',R3') negative to imply
          ff                        no output.
          75  CPSL     H'10'        Set register-bank to 0.
          10
          07  LODI,3   H'bf'        Set (R3) to index clearing of unpro-
          bf                        protected RAM.
    630*  cf  STRA,0   RAM+H'40'     Clear RAM from H'40'th byte on.
m         64
          40
          fb  BDRR,3   ED2          Branch unless clearing finished.
r         7b
          cc  STRA     ANUT+2*11    Clear 11th entry of ANUT.
m         04
          17
          cc  STRA     ANUT+2*11+1
m         04
          18
          07  LODI3    10           Set (R3) to index account numbers.
          0a
          04  LODI,0   8            Set (R0) to 8 for flag to turn light
          08                        off.
          bb  ZBSR     *JUL         Subroutine-branch to UL to turn light
as  640*  ae                        off.
          fb  BDRR,3   ED3          Branch unless all lights off.
r         7a
x   643*  17  RETC,U                Return to pre-subroutine.
                          SUBROUTINE CD
e   644*  0f  LODA,3    ACNN         Set (R3) to account number.
m         04
          00
          99  BCFR,P   CD3          Branch if account is either zero
r         0c                        or negative.
          20  EORZ     0
          bb  ZBSR     *JUL         Subroutine-branch to UL to turn on
as        ae                        this light.
          bb  ZBSR     *JTC         Subroutine-branch to TC to test if
as        b2                        continuous display is optioned.
x         16  RETC,N                If not optioned, return to pre-subroutine.
          09  LODR,1   *CD+1        Otherwise set (R1) to account number.
mr        f4
          bb  ZBSR     *JOD         Subroutine-branch to OD to start out-
as        a8                        display from ANUT entry.
          46  ANDI,2   H'8f'        Clear any timer bits in exec flag.
    654*  8f
x   655*  17  RETC,U                Return to pre-subroutine.
                          SUBROUTINE DV
```

-continued

```
e   6a0*  77  PPSL      H'10'          Set register-bank to 1.
          10
          05  LODI,1'   3              Assume display to be in .01-hours and
          03                           set fraction-divisor to 3.
          cc  STRA      H'e00'         Output knockdown to SENSE.
h         0e
          00
          cc  STRA      H'a01'         Does switch say MINUTES, not .01-HOURS?
h         0a
          01
          b4  TPSU      H'80'
          80
x         16  RETC,N                   If .01-HOURS, return to pre-subroutine.
          05  LODI,1'   5              Otherwise set fraction-divisor to 5
          05                           for minutes.
x   6af*  17  RETC,U                   Return to pre-subroutine.
                                 SUBROUTINE IT
e   688*  cc  STRA,0    WK1            Set (WK0,WK1) to address of counter.
m         04
          6a
          04  LODI,0    >>RAM
ma        04
          cc  STRA,0    WK0
m         04
          69
          0c  LODA,0    *WK0           Set (R0) = counter.
m         84
          69
          84  ADDI,0    1              Add one and subtract the cycling value.
          01
          a1  SUBZ      1
          18  BCTR,Z    IT2            Branch if zero result, that is, counter
r         01                           has cycled to zero.
    698*  81  ADDZ      1              Otherwise add cycling value back on.
          cc  STRA      *WK0           Store counter back in memory.
m         84
          69
x   69c*  17  RETC,U                   Return to pre-subroutine.
                                 SUBROUTINE UL
e   6e0*  d3  RRL,3                    Double (R3) for indexing.
          8f  ADDA,0    IDAT-1,3       Set (LA0,LA1) to output address.
ma        60
          37
          cc  STRA,0    LA1
m         04
          27
          0f  LODA,0    IDAT-2,3
ma        60
          36
          84  ADDI,0    3
          03
          cc  STRA,0    LA0
m         04
          26
          cc  STRA,0    *LA0           Output to specified address.
mh  6f0*  84
          26
          53  RRR,3                    Restore (R3) to account number.
x   6f3*  17  RETC,U                   Return to pre-subroutine.
                                 SUBROUTINE IA
e   6b0*  d1  RRL,1                    Double (R1) for indexing ANUT.
          8d  ADDA,0    ANUT+0,1       Add to (R0) the left byte of the ANUT
m         64                           entry and replace.
          01
          cd  STRA,0    ANUT+0,1
m         64
          01
          03  LODZ      3              Set (R0) to (R3).
          8d  ADDA,0    ANUT+1,1       Add to (R0) the right byte of the ANUT
m         64                           entry and replace.
          02
          cd  STRA,0    ANUT+1,1
m         64
          02
          c3  STRZ      3              Store this right-byte sum also in R3.
          13  SPSL                     Place carry bit, if any, in R0.
    6c0*  44  ANDI,0    1
          01
          8d  ADDA,0    ANUT+0,1       Add and replace the carry bit, if any,
m         64                           to the left byte of the ANUT entry.
          01
          cd  STRA,0    ANUT+0,1       (Contents of R0,R3 now equal ANUT entry)
```

-continued

```
m        64
         01
         a7  SUBI,3   H'30'        Subtract cycling value starting with
         30                        right byte.
         b5  TPSL     1            Did subtraction clear carry bit, im-
         01                        plying a borrow?
         18  BCTR,E   IA3          Branch if no borrow.
r        02
         a4  SUBI,0   1            Borrow from left byte of (R0,R3).
         01
    6d0* a4  SUBI,0   H'75'        Finish subtracting cycling value.
         75
         1a  BCTR,N   IA2          Branch to return if counter did not
r        07                        not cycle.
         cd  STRA,0   ANUT+0,1     Otherwise store new value.
m        64
         01
         03  LODZ     3
         cd  STRA,0   ANUT+1,1
m        64
         02
         51  RRR,1                 Restore (R1) as account.
x   6dc* 17  RETC,U                Return to pre-subroutine
                          SUBROUTINE TC
e   667* cc  STRA     H'e00'       Output knockdown to SENSE.
h        0e
         00
         cc  STRA     H'a02'       Output probe to continuous-display
h        0a                        switch.
         02
         b4  TPSU     H'80'        Test probe and set CC.
         80
x   66f* 17  RETC,U                Return to pre-subroutine.
                          SUBROUTINE CA
e   656* 20  EORZ     0            Clear (R0).
         cd  STRA,0   A12S,1       Clear entry in A12S.
m        64
         1a
         cd  STRA,0   A60C,1       Clear entry in A60C.
m        64
         34
         d1  RRL,1                 Double (R1) to index ANUT.
         cd  STRA,0   ANUT+0,1     clear ANUT entry.
m        64
         01
         cd  STRA,0   ANUT+1,1
m        64
         02
         51  RRR,1                 Restore (R1) to account number.
x   665* 17  RETC,U                Return to pre-subroutine.
                          SUBROUTINE OD
e   670* 01  LODZ     1            Set (R0) to account index in R1.
         77  PPSL     H'10'        Set register-bank to 1.
         10
         c1  STRZ     1'           Set (R1') to account index
         d1  RRL,1'                Double (R1') for indexing ANUT.
         0d  LODA,0   ANUT+0,1'    Set (R0) and then (R2') to left byte
m        64                        of ANUT entry.
         01
         c2  STRZ     2'
         0d  LODA,0   ANUT+1,1'    Set (R0) and then (R3') to right byte
m        64
         02
         c3  STRZ     3'
         bb  ZBSR     *JDV         Subroutine-branch to DV to put fract-
as       aa                        tion-divisor in R1'.
         cc  STRA     H'd06'       Output RESET.
h   680* 0d
         06
         75  CPSL     H'10'        Set register-bank to 0.
         10
         26  EORI,2   H'80'        Mark 'display active' in exec flag.
         08
x   686* 17  RETC,U                Return to pre-subroutine.
                          SUBROUTINE FT
e   5fc* 05  LODI,1    10          Set (R1) to index accounts 1 to 10,
         0a                        but backwards.
         cd  STRA,1   WK1          Save (R1) for later restoration.
m        04
         6a
         d1  RRL,1                 Double (R1) to index ANUT.
```

-continued

```
        0d  LODA,0   ANUT+1,1   Set (R0) and then (R3) to the right
m       64                      byte of an individual ANUT entry.
        02
        c3  STRZ     3
        0d  LODA,0   ANUT+0,1   Set (R0) to the left byte of an
m       64                      individual ANUT entry.
        01
        c1  STRZ     1          Store (R0) temporarily in R1.
        63  IORZ     3          Is this entry in ANUT really zero?
        18  BCTR,Z   FT2        Branch if really zero; otherwise
r   60c* 0b                     add to running total.
        01  LODZ     1          Restore (R0) to left byte of ANUT entry.
        05  LODI,1   11         Set (R1) to index 11th entry of ANUT.
        0b
        bb  ZBSR     *JIA       Subroutine-branch to IA to add (R0,R3)
as      ac                      to 11th entry of ANUT.
        01  LODZ     1          Set (R0) nonzero.
        09  LODR,1   *FT1+1     Restore (R1) to account index.
mr      ea
        cd  STRA,0   AFLG,1     Mark flashing in AFLG entry.
m       64
        40
        09  LODR,1   *FT1+1     Restore (R1) to account index, if not.
r       e5
        f9  BDRR,1   FT1        Branch unless all 10 entries considered.
r       62
x   61c* 17 RETC,U              Return to pre-subroutine.
```

The embodiments of the invention in which an exclusive property or right is claimed are defined as follows:

1. A device for monitoring and displaying time charged to any of a plurality of accounts comprising:

a first source of clock signals;

a plurality of keyboard actuated account switches, of which a separate account switch is associated with each of a plurality of primary accounts, each account switch being actuated by a separate key on the keyboard;

memory means for storing counts of clock signals respectively corresponding to times charged to each of a plurality of accounts including said primary accounts;

microprocessor means coupled to said source of clock signals and operable to distribute the clock signals supplied by said first source within said memory means among the accounts for which storage is provided, the account to which clock signals are supplied being changeable by a single switch actuation, the primary account to which any clock signal is added being determined exclusively by the last actuated account switch; and display means for displaying a time interval corresponding to the count in said memory means for a selected one of the plurality of accounts.

2. The device of claim 1 wherein:

said plurality of accounts includes an idle time account for accumulating a count of clock signals not distributed to any primary account;

a start/stop switch is associated with said idle time account;

a first actuation of said start/stop switch causes said microprocessor means to transfer distribution of the clock signals from a primary account to the idle time account; and a second actuation of said start/stop switch causes said microprocessor means to transfer distribution of the clock signals back to the account receiving the clock signals immediately preceding the first actuation of said start/stop switch.

3. The device of claim 2 wherein:

a read switch is provided;

said mircoprocessor responds to actuation of said read switch followed by actuation of an account switch within a predetermined time interval by causing said display means to display the amount of time charged to the primary account associated with the actuated account switch.

4. The device of claim 3 wherein:

a second source of clock signals is provided for producing clock signals at a more rapid rate than the clock signals produced by said first source;

an add switch is provided;

secondary storage means is provided for storing a count of clock signals from said second source;

said microprocessor means responds to actuation of said add switch by causing said secondary storage to accumulate a count of clock signals from said second sources at a rate which commences with an initial rate and increases with time from actuation of said add switch; and said microprocessor means responds to deactuation of said add switch followed by reactuation thereof within a predetermined times interval by causing said secondary storage to resume accumulating a count at a rate which commences with the initial rate and increases with time;

said microprocessor means responds to deactuation of said add switch followed by actuation of an account switch within a predetermined time interval by causing the count in said secondary storage to be added to the count stored for the primary account associated with the activated account switch.

5. The device of claim 4 wherein:

each clock signal from said first source represents a time interval of twelve seconds;

a mode switch is provided;

said microprocessor means responds to a first position of said mode switch by dividing the counts of clock signals stored in said memory means by five to provide for displaying fractional hours of time in minutes; and said microprocessor means responds to a second position of said mode switch by dividing the count of clock signals stored in said memory means by three to provide for displaying fractional hours of time in hundredths of an hour.

6. The apparatus of claim 5 including verification means for indicating which of said plurality of accounts has activity associated therewith at any time, said verification means including a visual indicator located adjacent each of said plurality of account switches.

7. The apparatus of claim 6 including:

a removable form having spaces for entries identifying each of said primary accounts and the time charged to each primary account, said removable form, said plurality of account switches and said visual indicators being arranged to permit maximum visual connection between the entry space, account switch and visual indicator for each primary account; and a holder for holding said removable form so that the entry spaces thereon are aligned with the associated account switches and visual indicators.

8. The apparatus of claim 7 wherein:

60 cycle per second alternating current provides the primary operating power and clock signals; and a rechargeable battery power supply and associated circuitry is provided to prevent loss of stored counts in the event of loss of primary operating power.

9. Apparatus for recording and displaying time charged to any of a plurality of accounts comprising:

a source of clock signals;

a plurality of account switches, each account switch being associated with a separate account;

memory means for accumulating and storing a plurality of distinct counts of clock signals;

microprocessor means connected to receive inputs from said source of clock signals and said plurality of switches and to supply inputs to said memory means, said microprocessor being programmed to respond to actuation of any account switch so as to cause said memory means to accumulate and store a count of clock signals for the account associated with that account switch, and to discontinue accumulating counts of clock signals for any other account; and display means for receiving a count of clock signals stored for a selected account and displaying a time interval corresponding to that count.

10. The apparatus of claim 9 wherein each of said plurality of account switches is actuated by a key on a keyboard.

11. The apparatus of claim 10 wherein:

the plurality of accounts includes a plurality of primary accounts;

primary account keys are associated with the primary accounts;

the primary account keys are arranged in a substantially linear array; and each primary account key is aligned with a location for an account name in a means for listing account names.

12. The apparatus of claim 10 wherein:

said plurality of account switches includes a plurality of primary account switches associated with the primary accounts, a start/stop switch and an idle switch;

said memory means includes locations for accumulating and storing counts of clock signals indicative of time chargeable to each of the primary accounts and a location for accumulating and storing for an idle time account a count of all clock signals indicative of time not chargeable to any primary account; and said microprocessor means is programmed to respond to a first actuation of said start/stop switch so as to discontinue accumulating a count of clock signals for any primary account and to commence accumulating and storing a count of clock signals for the idle time account, and to respond to a second actuation of said start/stop switch so as to discontinue accumulating a count of clock signals for the idle time account and to resume accumulating and storing a count of clock signals for the primary account which was active immediately preceding the first actuation of said start/stop switch; and an idle switch is provided, actuation of which causes said display means to display a time interval corresponding to the count of clock signals stored for the idle time account.

13. The apparatus of claim 12 including:

a removable form having spaces for entries identifying each of said plurality of primary accounts, the spaces on said removable form being spaced to permit alignment with said primary account keys; and a holder for holding said removable form so that the entry spaces thereon are aligned with the associated account keys.

14. The apparatus of claim 11, 12 or 13 further including verification means for indicating which of said plurality of primary accounts is active at any time, said verification means including a visual indicator located adjacent each primary account key.

15. The apparatus of claim 11, 12 or 13:

including a source of accelerated clock signals;

including an add switch;

including an add location in said memory means for accumulating a count of accelerated clock signals; and wherein said microprocessor means is programmed to respond to actuation of said add switch so as to cause a count of the accelerated clock signals to accumulate at a rate which commences with an initial rate and increases with time as long as said add switch remains actuated and a maximum rate is not exceeded.

16. The apparatus of claim 15 wherein said microprocessor means is programmed to respond to reactuation of said add switch within an predetermined time interval after deactuation thereof so as to cause accumulation of the accelerated clock signals to resume at a rate which commences with the initial rate and increases with time as long as said add switch remains actuated and the maximum rate is not exceeded.

17. The apparatus of claim 11, 12 or 13 wherein:

a read switch is provided; and said microprocessor means responds to actuation of said read switch followed by actuation, within a predetermined time interval, of an account switch associated with a selected account by causing said display means to display a time interval corresponding to the accumulated count for the selected account.

18. The apparatus of claim 17 wherein said display means includes:

a numerical display device; and a mode switch for providing an input to said microprocessor means for causing said display device to display a time interval in either hours and minutes or hours and hundredths of an hour.

* * * * *